US009232828B2

(12) United States Patent
Arlen et al.

(10) Patent No.: US 9,232,828 B2
(45) Date of Patent: Jan. 12, 2016

(54) ARTICLE OF FOOTWEAR WITH CUSTOMIZABLE STIFFNESS

(71) Applicant: NIKE, Inc., Beaverton, OR (US)

(72) Inventors: Erik T. Arlen, Paris (FR); Scott T. Keating, Portland, OR (US); Stephen D. Pelletier, Jr., Portland, OR (US)

(73) Assignee: NIKE, Inc., Beaverton, OR (US)

( * ) Notice: Subject to any disclaimer, the term of this patent is extended or adjusted under 35 U.S.C. 154(b) by 408 days.

(21) Appl. No.: 13/665,647

(22) Filed: Oct. 31, 2012

(65) Prior Publication Data

US 2014/0115928 A1 May 1, 2014

(51) Int. Cl.

| | |
|---|---|
| ***A43B 7/20*** | (2006.01) |
| ***A43B 5/04*** | (2006.01) |
| ***A43B 13/42*** | (2006.01) |
| ***A43B 23/08*** | (2006.01) |
| ***A43B 1/08*** | (2006.01) |

(52) U.S. Cl.

CPC ..... *A43B 5/0401* (2013.01); *A43B 5/0405* (2013.01); *A43B 7/20* (2013.01)

(58) Field of Classification Search

CPC ..... A43B 5/04; A43B 5/0401; A43B 5/0409; A43B 5/0415; A43B 23/0205

USPC ..... 36/116, 85, 93, 117.5, 68, 69, 50.5, 36/148, 108

See application file for complete search history.

(56) References Cited

U.S. PATENT DOCUMENTS

| | | | | | |
|---|---|---|---|---|---|
| 522,371 | A | | 7/1894 | Horn et al. | |
| 737,959 | A | | 9/1903 | Posner | |
| 1,205,206 | A | * | 11/1916 | Hofmeister | 36/89 |
| 1,548,172 | A | | 8/1925 | Redden | |
| 1,717,432 | A | * | 6/1929 | Botti | 36/90 |
| 3,419,974 | A | | 1/1969 | Lange | |
| 3,738,025 | A | | 6/1973 | Hanson et al. | |
| 3,858,337 | A | | 1/1975 | Vogel | |
| 3,977,098 | A | | 8/1976 | Chalmers | |
| 4,068,337 | A | | 1/1978 | Hanson et al. | |
| 4,523,392 | A | * | 6/1985 | Gabrielli | 36/10 |
| 4,606,808 | A | * | 8/1986 | Yamada | C10C 3/005 208/22 |
| 4,766,612 | A | * | 8/1988 | Patton, Sr. | A41D 19/01517 2/159 |
| 5,067,257 | A | * | 11/1991 | Coomer | 36/93 |
| 5,113,526 | A | * | 5/1992 | Wang et al. | 2/2.5 |
| 5,265,353 | A | * | 11/1993 | Marega et al. | 36/54 |
| 5,421,034 | A | * | 6/1995 | Keune | 2/239 |

(Continued)

FOREIGN PATENT DOCUMENTS

| | | |
|---|---|---|
| CH | 626793 | 12/1981 |
| CH | 654467 | 2/1986 |

(Continued)

*Primary Examiner* — Robert J Hicks
*Assistant Examiner* — Cameron A Carter
(74) *Attorney, Agent, or Firm* — Plumsea Law Group, LLC

(57) ABSTRACT

An article of footwear with customizable stiffness is provided. The article of footwear in the form of a snowboard boot is provided with stiffness elements that are inserted within retaining enclosures disposed on either side of an inner liner of the snowboard boot. Depending on the level of stiffness of the stiffener element, or lack thereof, different flex profiles having varying degrees of stiffness are available to the wearer to customize the stiffness of the snowboard boot when secured within a binding. A kit of parts is also disclosed that includes a pair of boots and two sets of interchangeable stiffener inserts to allow a wearer to customize the stiffness of the boots as desired.

40 Claims, 13 Drawing Sheets

(56) References Cited

U.S. PATENT DOCUMENTS

| | | | | |
|---|---|---|---|---|
| 5,509,217 | A * | 4/1996 | Condini | 36/10 |
| 5,606,808 | A * | 3/1997 | Gilliard et al. | 36/89 |
| 6,360,454 | B1 * | 3/2002 | Dachgruber et al. | 36/54 |
| 6,467,193 | B1 * | 10/2002 | Okajima | A43B 5/0405 36/10 |
| 6,877,257 | B2 * | 4/2005 | Delgorgue et al. | 36/69 |
| 6,935,054 | B2 * | 8/2005 | Hall et al. | 36/117.1 |
| 7,086,181 | B2 * | 8/2006 | Farys | 36/50.5 |

FOREIGN PATENT DOCUMENTS

| | | |
|---|---|---|
| EP | 364400 | 4/1990 |
| FR | 2830418 | 4/2003 |
| JP | 2063405 | 3/1990 |

* cited by examiner

ARTICLE OF FOOTWEAR WITH CUSTOMIZABLE STIFFNESS

BACKGROUND

The present invention relates generally to an article of footwear, and more specifically, to an article of footwear in the form of a snowboard boot with customizable stiffness.

Articles of footwear with rigid inserts or stays are known in the art. U.S. Pat. No. 737,959 to Posner discloses an ankle supporting shoe that includes flexible supports that are inserted into pockets vertically disposed along the upper. U.S. Pat. No. 1,548,172 to Redden discloses shoe upper that includes ankle supporting stays that are inserted into pockets. U.S. Pat. No. 5,606,808 to Gilliard et al. discloses an adjustably stiffenable snowboard boot that includes vertical elongate pockets on the surface of the upper to receive elongate, semi-rigid stiffening stays.

There exists a need in the art for an article of footwear that is configured with customizable stiffness to suit the degree or amount of stiffness desired by a wearer.

SUMMARY

In one aspect, the invention provides an article of footwear comprising: an outer shell, the outer shell including an upper and a sole structure; an inner liner, the inner liner being configured to be removably inserted within an interior of the outer shell; wherein the inner liner comprises an upper liner portion and a lower liner portion; a first retaining enclosure comprising a first securing end and a first receiving end disposed on the upper liner portion of the inner liner; a second retaining enclosure comprising a second securing end and a second receiving end, wherein the second retaining enclosure is disposed across at least a portion of the upper liner portion and a portion of the lower liner portion; the second retaining enclosure being disposed beneath the first retaining enclosure; and wherein the first retaining enclosure and the second retaining enclosure are configured to receive a stiffener element that extends from the first retaining enclosure to the second retaining enclosure.

In another aspect, the invention provides an article of footwear comprising: an outer shell, the outer shell including an upper and a sole structure; an inner liner, the inner liner being configured to be removably inserted within an interior of the outer shell; wherein the inner liner comprises an upper liner portion and a lower liner portion; a stiffening arrangement disposed on at least one of a lateral side and a medial side of the inner liner, the stiffening arrangement being disposed through at least a portion of the upper liner portion and a portion of the lower liner portion; wherein the stiffening arrangement comprises a stiffener element disposed within a first retaining enclosure disposed on the upper liner portion of the inner liner and a second retaining enclosure disposed across at least a portion of the upper liner portion and a portion of the lower liner portion; and wherein the second retaining enclosure is disposed beneath the first retaining enclosure.

In another aspect, the invention provides an article of footwear comprising: an outer shell, the outer shell including an upper and a sole structure; an inner liner, the inner liner being configured to be removably inserted within an interior of the outer shell; at least one stiffener element associated with at least one of a lateral side and a medial side of the inner liner; the at least one stiffener element having a centerline disposed along a middle of the stiffener element along a longitudinal direction, the centerline extending from a first end to a second end opposite the first end; and wherein the centerline has a first orientation at the first end and a second orientation at the second end, the first orientation being different than the second orientation.

In another aspect, the invention provides a kit of parts, the kit comprising: at least one article of footwear, the article of footwear including an outer shell and an inner liner; at least one set of stiffener elements that are configured to be inserted within at least one retaining enclosure disposed on the inner liner; wherein the inner liner comprises an upper liner portion and a lower liner portion; wherein the inner liner includes a stiffening arrangement disposed on each of a lateral side and a medial side of the inner liner, each stiffening arrangement being disposed through at least a portion of the upper liner portion and a portion of the lower liner portion; wherein each stiffening arrangement comprises a first retaining enclosure disposed on the upper liner portion of the inner liner and a second retaining enclosure disposed across at least a portion of the upper liner portion and a portion of the lower liner portion; and wherein the second retaining enclosure is disposed beneath the first retaining enclosure.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
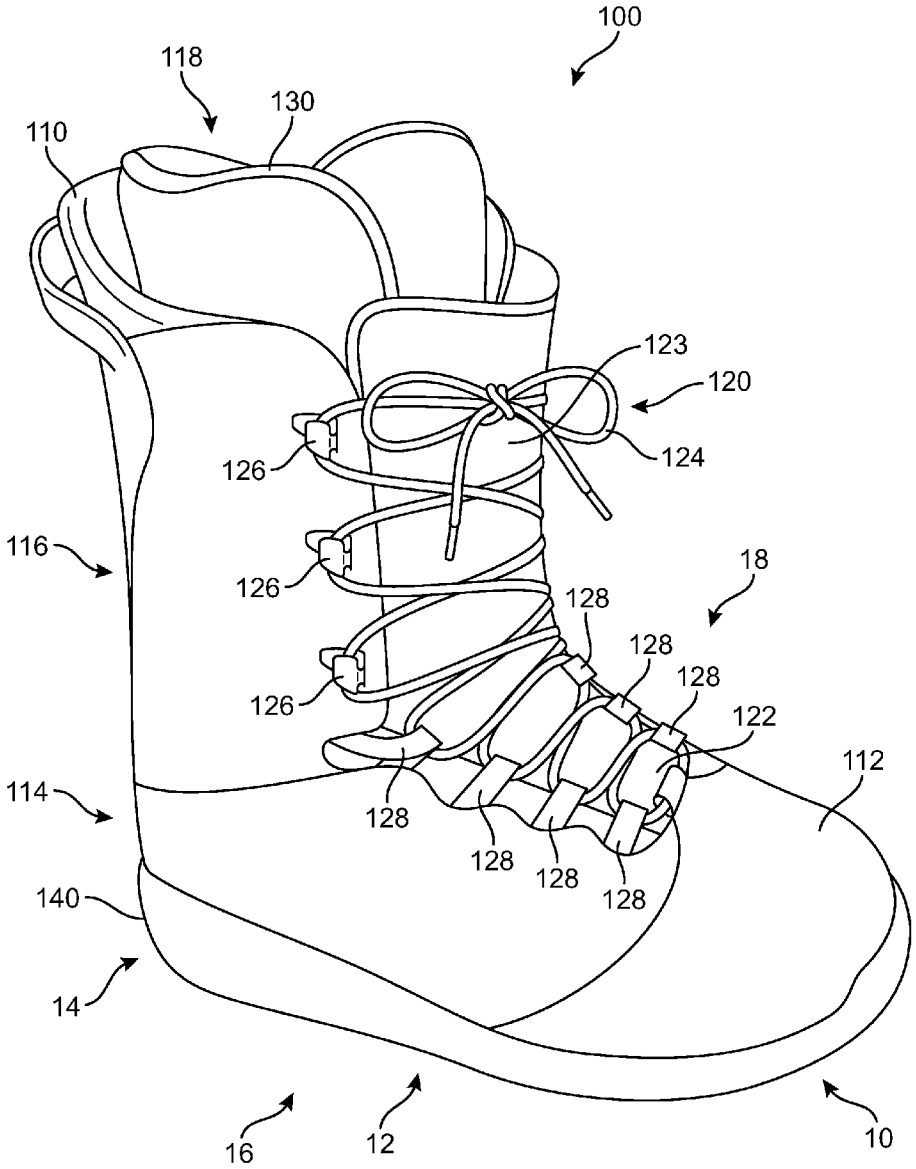
FIG. 1 is an isometric view of an exemplary embodiment of an article of footwear.
Figure 2:
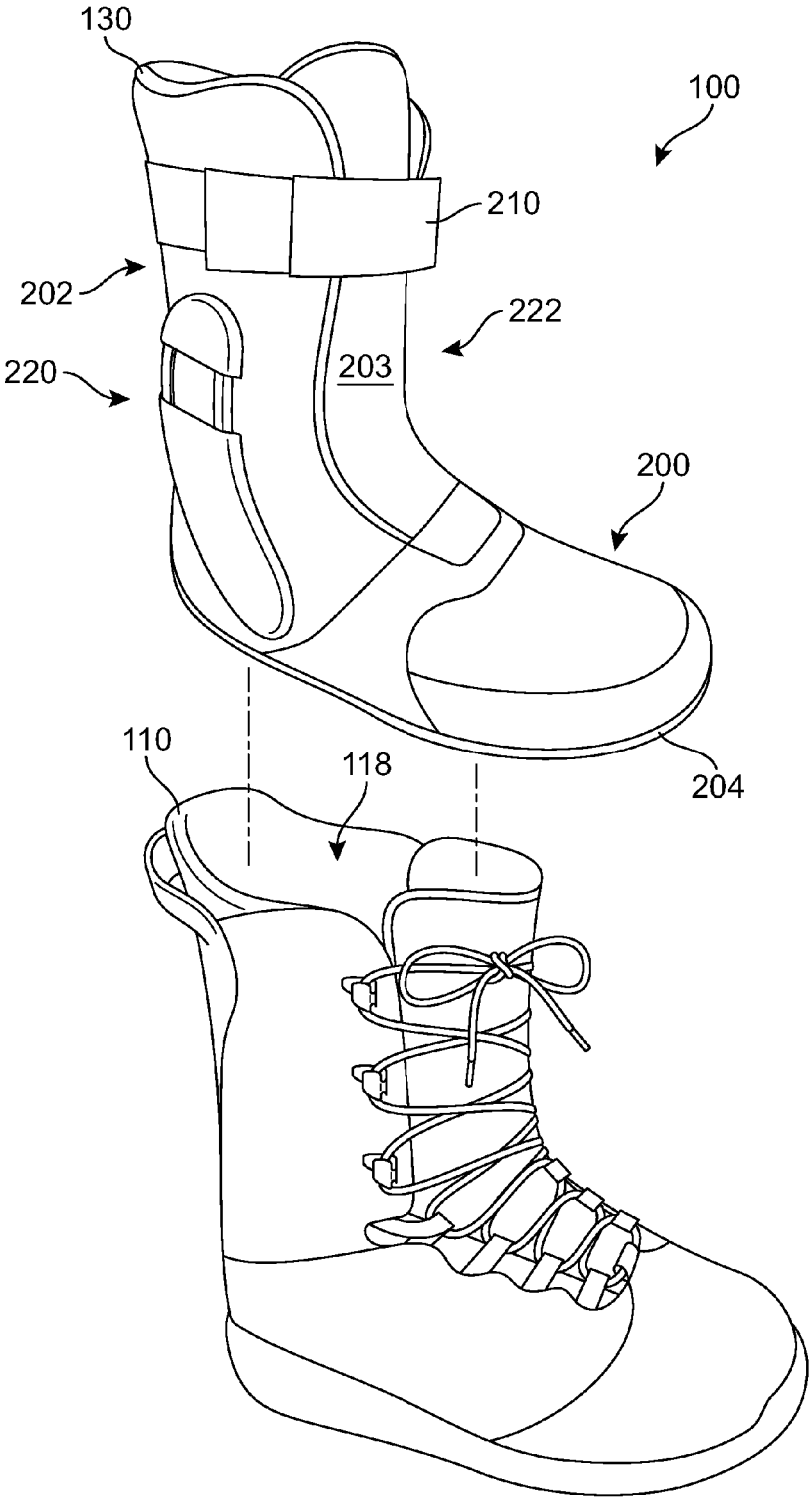
FIG. 2 is an exploded isometric view of an exemplary embodiment of an article of footwear.

FIGS. 1 and 2 illustrate an exemplary embodiment of article of footwear 100. In particular, FIG. 1 illustrates an isometric view of an exemplary embodiment of article of footwear 100 and FIG. 2 illustrates an exploded isometric view of an exemplary embodiment of article of footwear 100. For clarity, the following detailed description discusses an exemplary embodiment, in the form of a boot, but it should be noted that the present invention could take the form of any article of footwear including, but not limited to: soccer shoes, football shoes, sneakers, rugby shoes, baseball shoes as well as other kinds of shoes. Furthermore, the exemplary embodiments illustrate a boot configured to be used for snowboarding, however, in other embodiments the boot could be used for other activities such as skiing, hiking, or any other type of activity in which boots may be used.

As shown in FIGS. 1 and 2, article of footwear 100, also referred to simply as article 100, can be used with a right foot. It is understood that the following discussion may equally apply to a mirror image of article of footwear 100 that can be used with a left foot. Features discussed herein may apply equally well for an article of footwear configured for use with a left foot or for a right foot. However, some features discussed herein or configurations shown may provide particular advantages to an article of footwear configured for use with either a left foot or a right foot, such as a snowboard boot arranged for use as the lead boot for a user having a regular left foot forward stance or a right foot forward "goofy foot" stance.

For purposes of reference, article 100 may be divided into forefoot region 10, midfoot region 12 and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot region 10, midfoot region 12 and heel region 14.

It will be understood that forefoot region 10, midfoot region 12 and heel region 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot region 10, midfoot region 12 and heel region 14, as well as lateral side 16 and medial side 18, can also be applied to individual components of an article, such as a sole structure, an upper, and/or an inner liner of the article.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole.

In some embodiments, article 100 may include an outer shell 110 and an inner liner 130. Outer shell 110 and inner liner 130 may be removably associated with one another. In an exemplary embodiment, outer shell 110 may be configured to receive inner liner 130 within an interior of outer shell 110 to form article 100. With this configuration, inner liner 130 may be inserted and removed from outer shell 110.

In some embodiments, outer shell 110 may include an upper 112 and sole structure 140. Sole structure 140 is secured to upper 112 and extends between the foot and the ground when article 100 is worn. In different embodiments, sole structure 140 may include different components. For example, sole structure 140 may include an outsole, a midsole, and/or an insole. In some cases, one or more of these components may be optional.

In some embodiments, sole structure 140 may be configured to provide traction for article 100. In addition to providing traction, sole structure 140 may attenuate ground reaction forces when compressed between the foot and the ground during walking, running or other ambulatory activities. The configuration of sole structure 140 may vary significantly in different embodiments to include a variety of conventional or non-conventional structures. In some cases, the configuration of sole structure 140 may be configured according to one or more types of ground surfaces on which sole structure 140 may be used. Examples of ground surfaces include, but are not limited to: natural turf, synthetic turf, dirt, as well as other surfaces.

In embodiments where article of footwear 100 is a snowboard boot, sole structure 140 may include provisions for interacting with a snowboard. For example, in some cases, sole structure 140 may include features for receiving, and fastening to, bindings on a snowboard. Furthermore, sole structure 140 may include traction members to enhance grip between article 100 and a snowboard. For purposes of clarity, sole structure 140 is shown without any particular features for associating with a snowboard, but it will be understood that in different embodiments any such provisions known in the art may be used.

In some embodiments, upper 112 of outer shell 110 may be configured to receive inner liner 130 including a foot of a wearer of article 100. Generally, upper 112 may be any type of upper. In particular, upper 112 could have any design, shape, size and/or color. For example, in embodiments where article 100 is a basketball shoe, upper 112 could be a high top upper that is shaped to provide high support on an ankle. In embodiments where article 100 is a running shoe, upper 112 could be a low top upper. In an exemplary embodiment, upper 112 has the shape of a boot upper that completely covers a foot and provides additional coverage at an ankle.

In an exemplary embodiment, upper 112 of outer shell 110 may be provided with a lower portion 114 and an upper portion 116. In some cases, lower portion 114 may be associated with, and configured to receive, the toes, arch and heel of a foot. Upper portion 116 may extend upwards from lower portion 114. In some cases, upper portion 116 may be associated with an ankle of a foot. In an exemplary embodiment, upper portion 116 may be a cuff portion for upper 112 of outer shell 110.

Upper 112, including both lower portion 114 and upper portion 116, may define a void in article 100 for receiving and securing inner liner 130 including a foot relative to sole structure 140. In particular, the void is shaped to accommodate inner liner 130 including a foot and extends along the lateral side of the foot, along the medial side of the foot, over the foot and under the foot. In some cases, outer shell 110 may be provided with an entry hole 118 that provides access to the void within upper 112. In an exemplary embodiment, entry hole 118 may be provided at a top end of upper portion 116.

Article 100 may include lacing system 120 for purposes of adjusting upper 112. In some cases, lacing system 120 may extend from forefoot region 10 through midfoot region 12 of article 100. Furthermore, in some cases, lacing system 120 may extend through lower portion 114 and upper portion 116 of upper 112. In particular, lacing system 120 may be associated with lacing region 122 that is disposed between lateral side 16 and medial side 18 of upper 112.

In some embodiments, upper 112 may include a tongue 123 that extends through lacing region 122 of upper 112. In some cases, tongue 123 may be integrally formed with upper 112. In other cases, however, tongue 123 may be a separate component from upper 112 and may be attached to upper 112 using conventional methods such as stitching or adhesives. In some cases, tongue 123 may include padding or other cushioning material to provide comfort to a foot of a wearer of article 100.

In some embodiments, lacing system 120 may include lacing member 124. The term "lacing member", as used throughout this detailed discussion, refers to any type of lace that may be used with an article of footwear. Generally, the size, including cross sectional shape and length, of lacing member 124 may be varied. Also, lacing member 124 may be made of any material, including, but not limited to: various types of natural and/or synthetic fibers, as well as other types of materials that may be used as laces. Furthermore it should be understood that although a single lacing member is shown in this preferred embodiment, other embodiments may incorporate more than one lace.

In some embodiments, lacing system 120 may include provisions for securing lacing member 124 to various portions of upper 112 and outer shell 110. In some embodiments, lacing system 120 may include lace receiving members configured to receive portions of lacing member 124. In other words, these lace receiving members may function in a similar manner to traditional eyelets. In different embodiments, different types of lace receiving members may be used. Examples of different lace receiving members include but are not limited to: eyelets, hooks, lace loops, as well as other types of lace receiving members.

In some embodiments, lacing system 120 may include lace hook members 126. In particular, lace hook members 126 may include a plurality of lace hook members disposed on either side of lacing gap 122 along a medial edge and a lateral edge of upper portion 116 of upper 112 on outer shell 110. In an exemplary embodiment, lace hook members 126 may be traditional types of lace hooks. Generally, lace hooks of lace hook members 126 may have any shape that is configured to receive lacing member 124 for the purposes of tightening the medial edge and the lateral edge on opposite sides of lacing gap 122 on upper portion 116 of upper 112. It will be understood that in other embodiments, different types of lace receiving members could be used in place of lace hooks.

In some embodiments, lacing system 120 may further include lace loop members 128. In particular, lace loop members 128 may include a plurality of lace loop members disposed on either side of lacing gap 122 along a medial edge and a lateral edge of lower portion 114 of upper 112 on outer shell 110. In an exemplary embodiment, lace loops of lace loop members 128 may have any shape that is configured to receive lacing member 124 for the purposes of tightening the medial edge and lateral edge on opposite sides of lacing gap 122 on lower portion 114 of upper 112. It will be understood that in other embodiments, different types of lace receiving members could be used in place of lace loops.

In different embodiments, the materials used for the various components of article 100 may vary. For example, sole structure 140 may be made from any suitable material, including, but not limited to: elastomers, siloxanes, natural rubber, other synthetic rubbers, aluminum, steel, natural leather, synthetic leather, or plastics. In some cases, the materials used for making sole structure 140 may be selected to accomplish stability and cushioning for a foot undergoing forces typically associated with snowboarding.

Also, outer shell 110 and/or upper 112 may be made from any suitable material. Examples of materials for outer shell 110 and/or upper 112 include, but are not limited to: nylon, natural leather, synthetic leather, natural rubber or synthetic rubber, plastics and polymers, and/or other suitable materials used in footwear construction. In some cases, outer shell 110 and/or upper 112 may be made of any suitable knitted, woven or non-woven material. In an exemplary embodiment, outer shell 110 and/or upper 112 may be made of a combination of layers. For example, in some cases, outer shell 110 and/or upper 112 may be provided with an outer layer made of synthetic leather, which can enhance the durability of upper 112. The outer layer can be reinforced on an interior side of upper 112 by an inner layer made of, for example, a synthetic fabric that provides padding and/or insulation.

In an exemplary embodiment, article 100 may include inner liner 130 that is configured to be inserted into entry hole 118 within the interior of outer shell 110 to fill the void defined by upper 112. Inner liner 130 may be made from any suitable material. Examples of materials for inner liner 130 include, but are not limited to: nylon, cotton, polyester, natural and/or synthetic fibers or blends, as well as any of the materials used for upper 112, including natural leather, synthetic leather, natural or synthetic rubber, plastics and polymers, and/or other suitable materials used in footwear construction. In some cases, inner liner 130 may be made of any suitable knitted, woven or non-woven material. In an exemplary embodiment, inner liner 130 may be made of a combination of materials. In some cases, inner liner 130 may be made of a material that is configured to provide comfort to a foot of a wearer when disposed within article 100. In an exemplary embodiment, inner liner 130 may be made of a combination of layers. For example, in some cases, inner liner 130 may be provided with an outer layer that is configured to be disposed along the inside of outer shell 110 and an inner layer that is configured to be disposed within the interior of inner liner 130.

Referring now to FIG. 2, an exploded view of article 100, including outer shell 110 and inner liner 130 is illustrated. In this embodiment, inner liner 130 may be seen removably disposed from within the interior of outer shell 110. As discussed above, in some embodiments, inner liner 130 may be inserted and withdrawn from outer shell 110 through entry hole 118.

In an exemplary embodiment, inner liner 130 may have a corresponding shape as outer shell 110. For example, in cases where outer shell 110 and/or upper 112 is configured to be a low top upper, inner liner 130 may have a similar shape. In this embodiment, where outer shell 110 and/or upper 112 is a boot, inner liner 130 may have a corresponding shape. In an exemplary embodiment, inner liner 130 may be provided with a lower liner portion 200 and an upper liner portion 202. In some cases, lower liner portion 200 may be associated with, and configured to receive, the toes, arch and heel of a foot. Upper liner portion 202 may extend upwards from lower liner portion 200. In some cases, upper liner portion 202 may be associated with an ankle of a foot. In an exemplary embodiment, upper liner portion 202 may be a cuff portion for inner liner 130.

In an exemplary embodiment, inner liner 130 may include a bottom 204 disposed on lower liner portion 200. Bottom 204 of inner liner 130 may be configured to rest along the bottom interior of outer shell 110 inside of upper 112. In some cases, bottom 204 may be made of a different material from the rest of inner liner 130 that is configured to provide traction or friction with the interior of outer shell 110. In other cases, bottom 204 may be treated with an applied coating or material to increase the traction or friction with the interior of outer shell 110. In one embodiment, bottom 204 may include a rubberized coating.

In some embodiments, inner liner 130 may include a tongue 203 that extends through upper liner portion 202 and into a portion of lower liner portion 200. In an exemplary embodiment, tongue 203 may correspond approximately to lacing region 122 of upper 112. In some cases, tongue 203 may be integrally formed with inner liner 130. In other cases, however, tongue 203 may be a separate component from inner liner 130 and may be attached to inner liner 130 using conventional methods such as stitching or adhesives. In some cases, tongue 203 may include padding or other cushioning material to provide comfort to a foot of a wearer of article 100.

In some embodiments, inner liner 130 may be provided with a fastening member 210. Fastening member 210 may be a strap or other mechanism that is configured to tighten upper liner portion 202 of inner liner 130 on a foot of a wearer. In an exemplary embodiment, fastening member 210 may be secured to inner liner 130 on a first side and may be adjustably secured to an anchor disposed on the exterior of inner liner 130 on a second side to allow fastening member 210 to be drawn tight. In one embodiment, fastening member 210 may include hook and loop fasteners to hold fastening member 210 in a closed position on inner liner 130. In other embodiments, other tightening or fastening mechanisms may be used to tighten inner liner 130 around a foot of a wearer.

In some embodiments, article 100 may be provided with components that are configured to provide customizable stiffness and flexibility to a wearer. In an exemplary embodiment, inner liner 130 may include one or more stiffening arrangements disposed along inner liner 130 through a portion of upper liner portion 202 and/or lower liner portion 200 along each of lateral side 16 and medial side 18. In one embodiment, the stiffening arrangements may be provided on the exterior surface of inner liner 130. In other embodiments, however, the stiffening arrangements may be disposed between one or more layers of inner liner 130.

Referring again to FIG. 2, in this embodiment, inner liner 130 includes a lateral stiffening arrangement 220 disposed on lateral side 16 of inner liner 130. Inner liner 130 may also include a medial stiffening arrangement 222 disposed on medial side 18 of inner liner 130, opposite lateral stiffening arrangement 220. In an exemplary embodiment, stiffening arrangements, including lateral stiffening arrangement 220 and/or medial stiffening arrangement 222, may be provided on inner liner 130 to allow a wearer to customize the stiffness and/or flexibility of article 100 when worn by the wearer, as described in more detail below.

Figure 3:
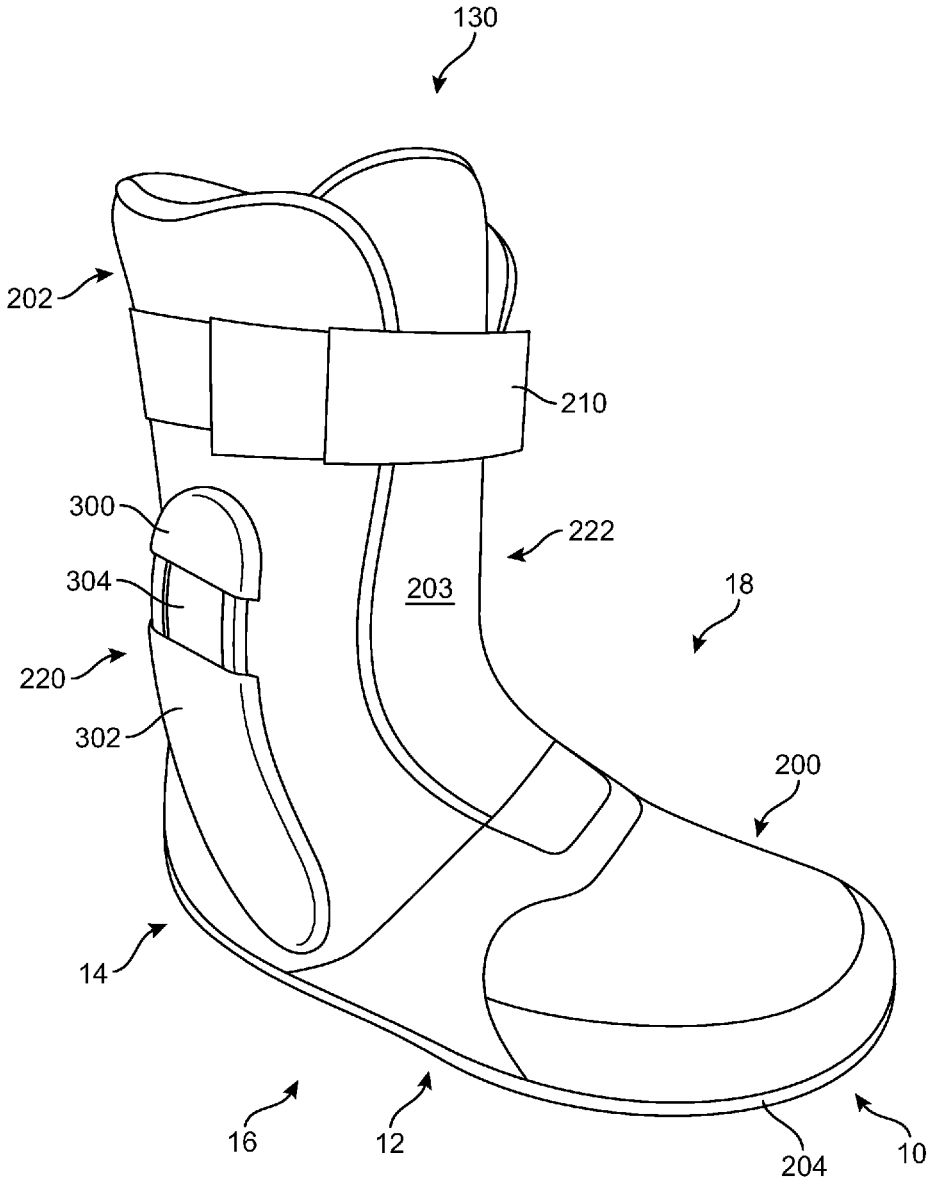
FIG. 3 is a lateral isometric view of an exemplary embodiment of an inner liner for an article of footwear.

FIG. 3 illustrates a lateral isometric side view of inner liner 130. In some embodiments, inner liner 130 may be configured for insertion into outer shell 110 to form a boot. In an exemplary embodiment, inner liner 130 may be provided with stiffening arrangements, including lateral stiffening arrangement 220 and medial stiffening arrangement 222, disposed on opposite sides of inner liner 130. In some embodiments, lateral stiffening arrangement 220 may include a number of components. In an exemplary embodiment, lateral stiffening arrangement 220 may include one or more retaining enclosures that are configured to receive and hold a stiffener in place on inner liner 130.

In one embodiment, lateral stiffening arrangement 220 may include an upper retaining enclosure 300 and a lower retaining enclosure 302. In some cases, upper retaining enclosure 300 and/or lower retaining enclosure 302 may be pockets or cavities disposed along the exterior surface of inner liner 130 that are configured to receive and hold in place a stiffener or other rigid, semi-rigid, or flexible member. In other cases, upper retaining enclosure 300 and/or lower retaining enclosure 302 may be pockets or cavities disposed within or between layers of inner liner 130.

In some embodiments, each of upper retaining enclosure 300 and/or lower retaining enclosure 302 may receive and hold a stiffener element 304. In an exemplary embodiment, stiffener element 304 may be a rigid, semi-rigid, or flexible member that is configured to provide or permit a desired amount of stiffness or flexibility to article 100. In an exemplary embodiment, upper retaining enclosure 300 and lower retaining enclosure 302 are configured to hold opposite ends of stiffener element 304 in place so that stiffener element 304 has a predetermined alignment along the exterior surface of inner liner 130 on lateral side 16.

In an exemplary embodiment, lateral stiffening arrangement 220 may be configured so that upper retaining enclosure 300 and lower retaining enclosure 302 hold stiffener element 304 in place at least through a portion of upper liner portion 202 and a portion of lower liner portion 200. In addition, in an exemplary embodiment, lateral stiffening arrangement 220 may further be configured so that stiffener element 304 is configured to be disposed through at least a portion of midfoot region 12 and/or heel region 14. In one embodiment, the location of lateral stiffening arrangement 220 may be made to approximately coincide with the location of an ankle of a foot a wearer when disposed within article 100. With this arrangement, stiffener element 304 may be configured to provide stiffness and/or flexibility to assist with support, stability, and/or range of motion of an ankle of a foot within article 100.

Figure 4:
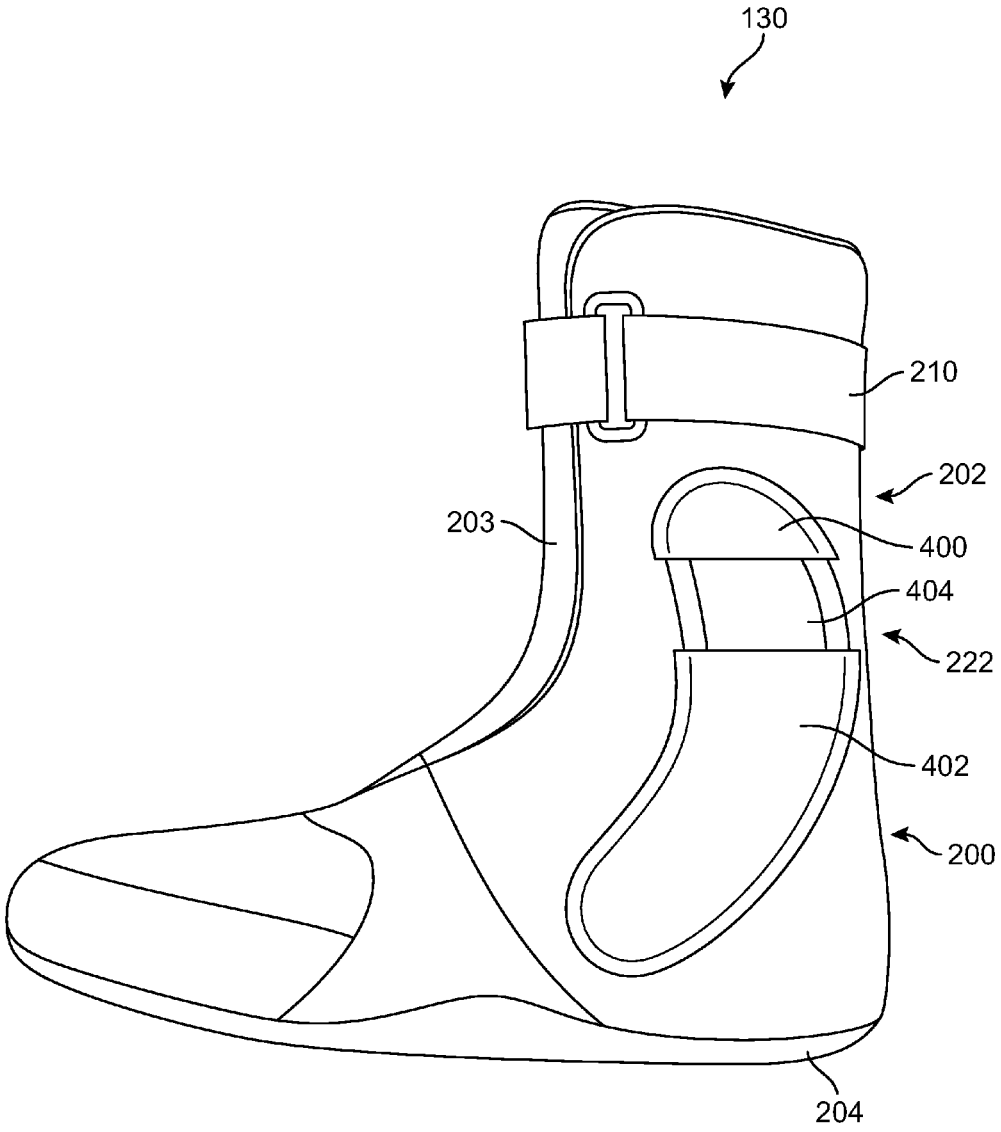
FIG. 4 is a medial side view of an exemplary embodiment of an inner liner for an article of footwear.

Referring now to FIG. 4, a medial side view of inner liner 130 is illustrated. In some embodiments, medial stiffening arrangement 222 may have a substantially similar structure as lateral stiffening arrangement 220, described above. In an exemplary embodiment, medial stiffening arrangement 222 may include one or more retaining enclosures that are configured to receive and hold a stiffener in place on inner liner 130. In this embodiment, medial stiffening arrangement 222 may include an upper retaining enclosure 400 and a lower retaining enclosure 402. In some cases, upper retaining enclosure 400 and/or lower retaining enclosure 402 may be pockets or cavities disposed along the exterior surface of inner liner 130 that are configured to receive and hold in place a stiffener or other rigid, semi-rigid, or flexible member. In other cases, upper retaining enclosure 400 and/or lower retaining enclosure 402 may be pockets or cavities disposed within or between layers of inner liner 130.

In some embodiments, portions of lateral stiffening arrangement 220 and medial stiffening arrangement 222, including upper retaining enclosures 300 and 400 and lower retaining enclosures 302 and 402, may be made of any suitable materials, including any suitable materials used to make article 100, including inner liner 130 and/or outer shell 110. In an exemplary embodiment, upper retaining enclosures 300 and 400 and lower retaining enclosures 302 and 402 may be made of a synthetic or natural leather material or other woven or non-woven fabrics or textiles. In other embodiments, any suitable materials may be used.

In some embodiments, each of upper retaining enclosure 400 and/or lower retaining enclosure 402 may receive and hold a stiffener element 404. In an exemplary embodiment, stiffener element 404 may be substantially similar to stiffener element 304, described above. In an exemplary embodiment, upper retaining enclosure 400 and lower retaining enclosure 402 are configured to hold opposite ends of stiffener element 404 in place so that stiffener element 404 has a predetermined alignment along the exterior surface of inner liner 130 on medial side 18.

In an exemplary embodiment, medial stiffening arrangement 222 may be configured so that upper retaining enclosure 400 and lower retaining enclosure 402 hold stiffener element 404 in place at least through a portion of upper liner portion 202 and a portion of lower liner portion 200. In addition, in an exemplary embodiment, medial stiffening arrangement 222 may further be configured so that stiffener element 404 is configured to be disposed through at least a portion of midfoot region 12 and/or heel region 14. In one embodiment, the location of medial stiffening arrangement 222 may be made to approximately coincide with the location of an ankle of a foot a wearer when disposed within article 100. With this arrangement, stiffener element 404 may be configured to provide stiffness and/or flexibility to assist with support, stability, and/or range of motion of an ankle of a foot within article 100.

Figure 5:
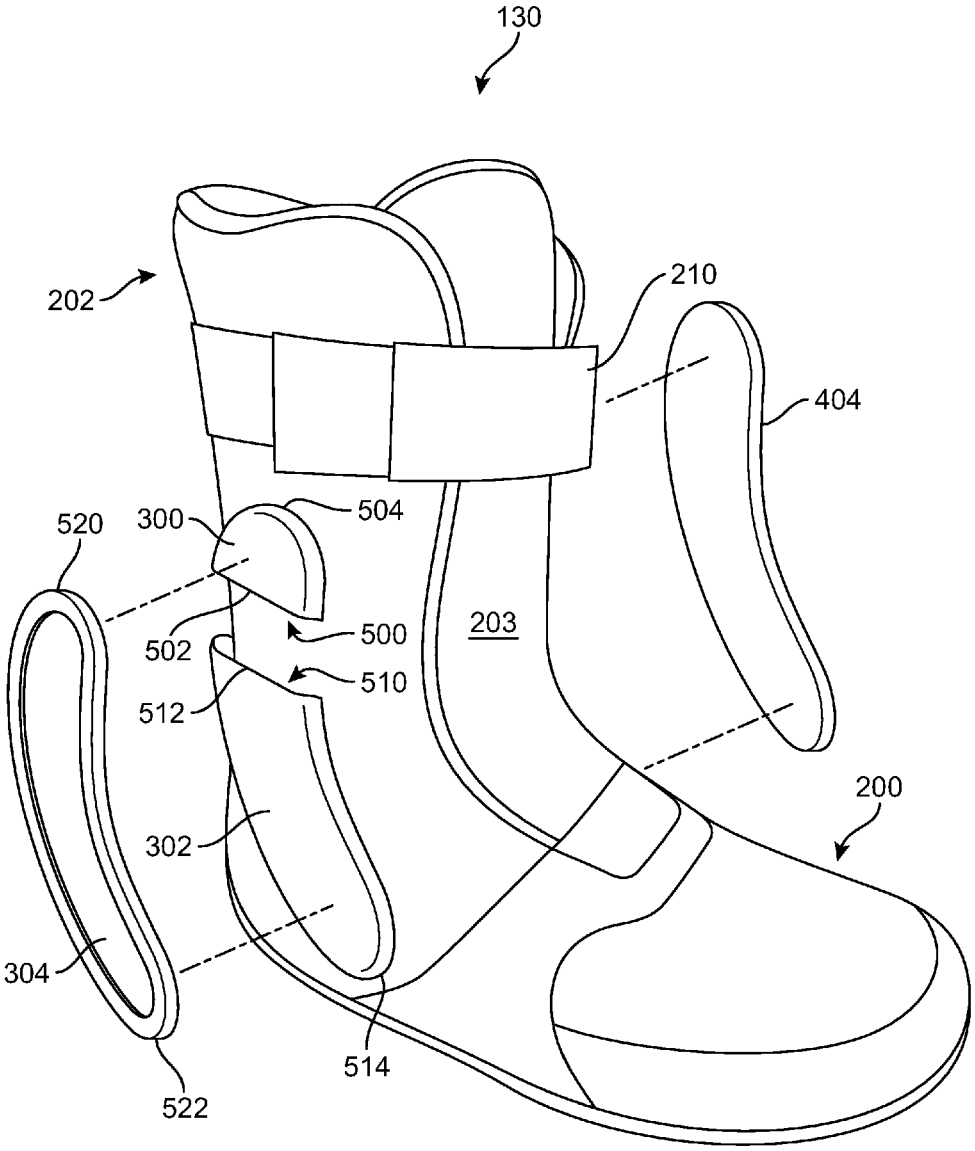
FIG. 5 is an exploded lateral isometric view of an exemplary embodiment of an inner liner for an article of footwear with stiffener elements.

Referring now to FIG. 5, an exploded lateral view of inner liner 130 with stiffener elements 304 and 404 is illustrated. As described above, each of lateral stiffening arrangement 220 on lateral side 16 of inner liner 130 and medial stiffening arrangement 222 on medial side 18 of inner liner 130 include retaining enclosures in the form of pockets or cavities that are configured to hold in place stiffener element 304 and 404. In some embodiments, the retaining enclosures may be provided with openings to permit insertion of the stiffening elements. In an exemplary embodiment, each of upper retaining enclosure 300 and/or lower retaining enclosure 302 may be provided with an open receiving end to permit insertion of a stiffener and a closed securing end to secure the stiffener in place within the retaining enclosure. Together, the closed securing end and the open receiving end may form a pocket or cavity that is configured to receive at least a portion of a stiffener element.

In one embodiment, upper retaining enclosure 300 may include an upper opening 500 that is located at an upper receiving end 502 and extends to an upper securing end 504. In an exemplary embodiment, upper securing end 504 may located higher along upper liner portion 202 of inner liner 130 than upper receiving end 502. In this embodiment, upper securing end 504 is disposed adjacent to fastening member 210 towards the top end of inner liner 130 and upper receiving end 502 is disposed below upper securing end 504 towards approximately a middle portion of inner liner 130.

In one embodiment, lower retaining enclosure 302 may include a lower opening 510 that is located at a lower receiving end 512 and extends down to a lower securing end 514. In an exemplary embodiment, lower securing end 514 may located along lower liner portion 200 of inner liner 130 beneath lower receiving end 512. In this embodiment, lower securing end 514 is disposed adjacent to bottom 204 within midfoot region 12 of lower liner portion 200 of inner liner 130 and lower receiving end 512 is disposed below upper receiving end 502 towards approximately a middle portion of inner liner 130.

In some embodiments, stiffener elements 304 and 404 may be configured to be inserted within the openings formed on the respective retaining enclosures on lateral side 16 and/or medial side 18 of inner liner 130. In an exemplary embodiment, a proximal end 520 of stiffener 304 may be configured to be placed within upper opening 500 by being inserted through upper receiving end 502. Similarly, a distal end 522 of stiffener 304 may be configured to be placed within lower opening 510 by being inserted through lower receiving end 512. It should be understood that upper retaining enclosure 400 and/or lower retaining enclosure 402 disposed on medial side 18 of inner liner 130 include correspondingly similar structures as those described with regard to upper retaining enclosure 300 and/or lower retaining enclosure 302 to form substantially similar openings for stiffener element 404.

Figure 6:
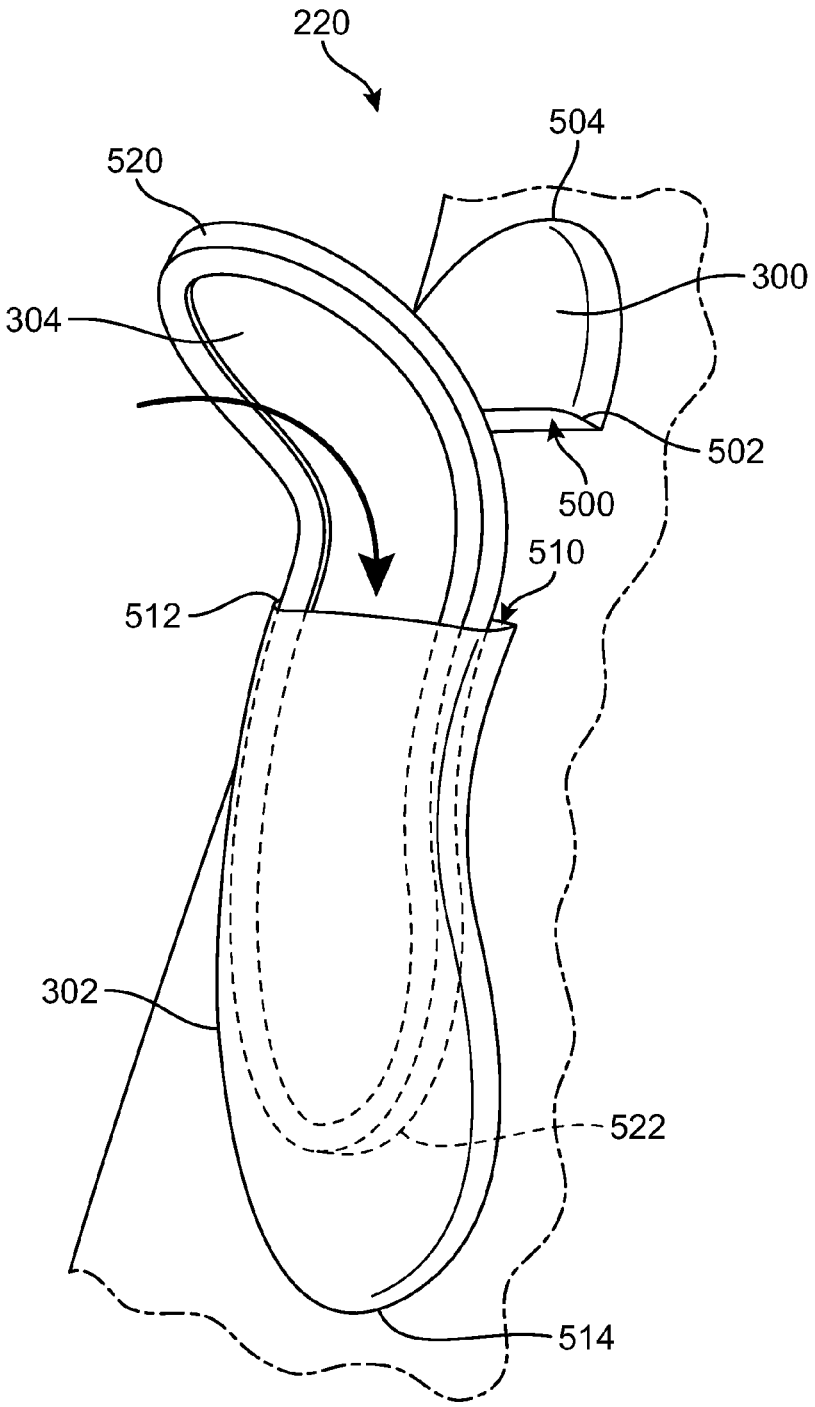
FIG. 6 is an enlarged representational view of an exemplary embodiment of a stiffener element being placed within a retaining enclosure on an inner liner.
Figure 7:
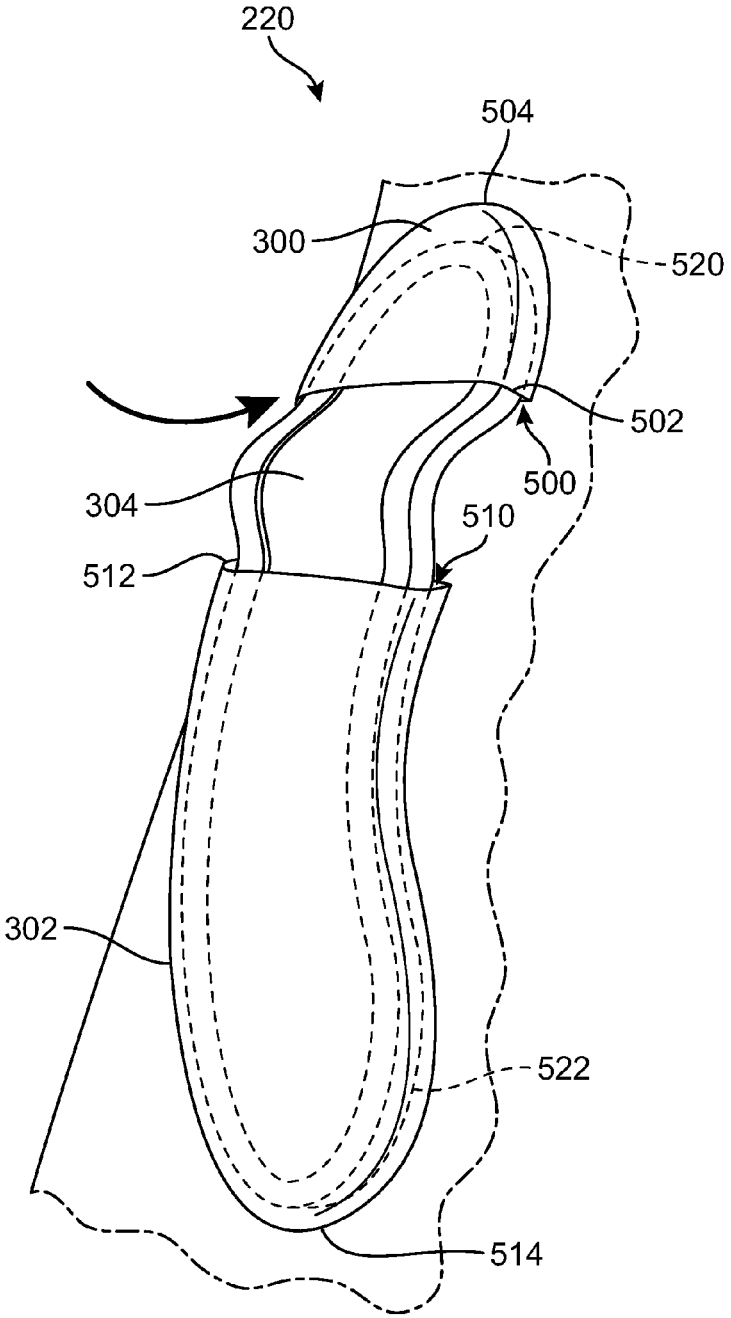
FIG. 7 is an enlarged representational view of an exemplary embodiment of a stiffener element being placed within a retaining enclosure on an inner liner.

FIGS. 6 and 7 illustrate an exemplary process for inserting a stiffener element into the corresponding opening formed by the retaining enclosures associated with lateral stiffening arrangement 220 on inner liner 130. It should be understood that the order of the steps described herein is merely exemplary and may be performed in any order. In addition, a substantially similar process may be used to place any stiffener element within a respective retaining enclosure, including stiffener element 404 within the retaining enclosures of medial stiffening arrangement 222.

Referring now to FIG. 6, stiffener element 304 may be configured to be inserted within openings associated with each of upper retaining enclosure 300 and lower retaining enclosure 302. Distal end 522 of stiffener element 302 may be inserted within lower opening 510 at lower receiving end 512 of lower retaining enclosure 302. In some cases, where stiffener element is semi-rigid or flexible, stiffener element 304 may be slightly bent to assist with insertion within lower opening 510. In other cases, where stiffener element is rigid or otherwise not easily bent, portions of lower retaining enclosure 302 may stretch or flex to assist with insertion within lower opening 510.

As shown in FIG. 6, when stiffener element 304 is inserted within lower opening 510 of lower retaining enclosure 302 at lower receiving end 512, distal end 522 of stiffener element 304 moves downward within lower retaining enclosure 302 towards lower securing end 514. Referring now to FIG. 7, once distal end 522 of stiffener element 304 has reached lower securing end 514, proximal end 520 of stiffener element 304 may be inserted within upper opening 500 of upper retaining enclosure 300 at upper receiving end 502. In this embodiment, stiffener element 304 may be bent slightly to assist with inserting proximal end 520 within upper opening 500. As noted above, however, in other embodiments where a rigid stiffener element is used, upper retaining enclosure 300 may be configured to stretch or flex.

As shown in FIG. 7, proximal end 520 of stiffener element 304 moves upwards towards upper securing end 504. With this arrangement, stiffener element 304 may be placed within lateral stiffening arrangement 220 by associating proximal end 520 at upper securing end 504 within upper opening 500 of upper retaining enclosure 300 and by associating distal end 522 at lower securing end 514 within lower opening 510 of lower retaining enclosure 302. In this embodiment, upper receiving end 502 of upper retaining enclosure 300 is separated from lower receiving end 512 of lower retaining enclosure 302 so as to form a gap or space between the two retaining enclosures. A portion of stiffener element 304 may be exposed or visible within this gap or space. In other embodiments, however, upper receiving end 502 and lower receiving end 512 may be located approximately abutting so as to reduce or eliminate the gap or space in between.

Figure 8:
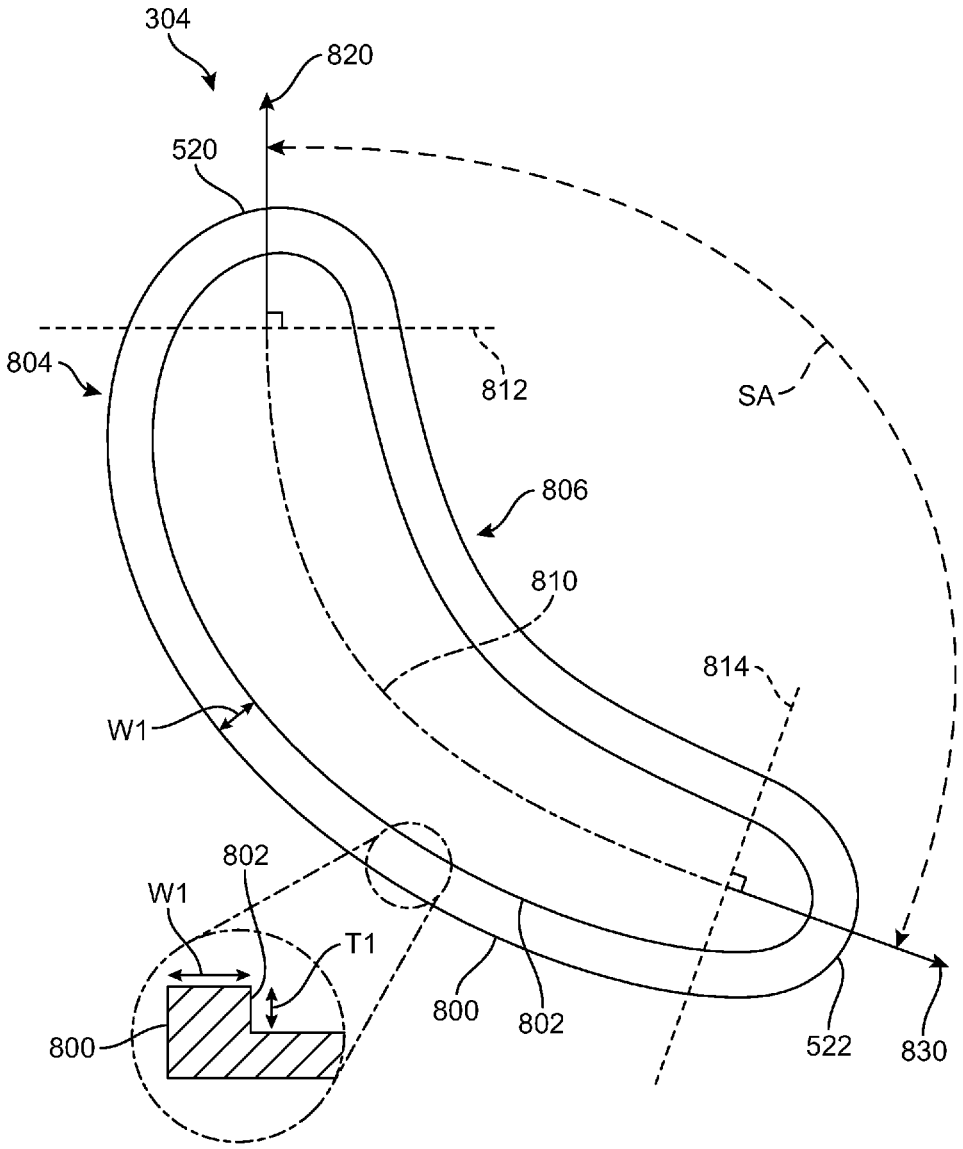
FIG. 8 is a plan view of an exemplary embodiment of a stiffener element.

FIG. 8 illustrates a top down plan view of stiffener element 304. In some embodiments, stiffener element 304 may be associated with an outer peripheral edge 800. Outer peripheral edge 800 extends around the perimeter of stiffener element 304. In an exemplary embodiment, stiffener element 304 may further include an inner peripheral edge 802. Inner peripheral edge 802 extends around stiffener element 304 spaced apart from the perimeter by a first width W1. In this embodiment, inner peripheral edge 802 is substantially parallel with outer peripheral edge 800 along the entirety of the perimeter of stiffener element 304. In other embodiments, however, the distance between outer peripheral edge 800 and inner peripheral edge 802 may vary.

In some embodiments, outer peripheral edge 800 and inner peripheral edge 802 may form a lip or border having first width W1 along the perimeter of stiffener element 304. In an exemplary embodiment, the lip formed by outer peripheral edge 800 and inner peripheral edge 802 may define a portion of stiffener element 304 that has a greater cross-sectional thickness than the remaining portion of stiffener element 304. As shown in the cross-sectional view in FIG. 8, outer peripheral edge 800 and inner peripheral edge 802 may have a first thickness T1 that extends above the surface of the remaining portion of stiffener element 304. With this arrangement, the increased thickness of the lip or border extending around the perimeter of stiffener element 304 may provide additional stiffness and/or rigidity to stiffener element 304.

In some embodiments, the stiffener elements associated with the stiffening arrangements may have a shape that is approximately kidney-shaped or comma-shaped. In an exemplary embodiment, stiffener element 304 may be approximately comma-shaped, with a wide end and a narrow end opposite the wide end. In this embodiment, proximal end 520 of stiffener element 304 may be the wide end and distal end 522 may be the narrow end. In other embodiments, proximal end 520 and distal end 522 may be approximately similar widths to give stiffener element 304 an approximately kidney-shaped appearance.

In some embodiments, the shape of stiffener element 304 may be further defined by a trailing side 804 and a leading side 806 that are associated with opposite curvatures. In an exemplary embodiment, one of trailing side 804 and leading side 806 may be associated with a convex curvature and the opposite side may be associated with a concave curvature. In this embodiment, trailing side 804 may be approximately convex and leading side 806 may be approximately concave. With this arrangement, the curvature of stiffener element 304 may further be associated with a generally kidney-shaped or comma-shaped appearance.

In some embodiments, the curvature of stiffener element 304 may cause the opposite ends of stiffener element 304 to have a skewed or offset relation. Stiffener element 304 may be generally associated with a centerline 810 that is located approximately in the middle of stiffener element 304 along the longitudinal direction. In an exemplary embodiment, centerline 810 follows the curvature associated with the shape of stiffener element 304. At each end of stiffener element 304, centerline 810 may have an orientation that is associated with a direction perpendicular to the lateral axis across stiffener element 304 at the respective end. In this embodiment, a first lateral axis 812 extends between trailing side 804 and leading side 806 in the lateral direction at proximal end 520. Similarly, a second lateral axis extends between trailing side 804 and leading side 806 in the lateral direction at distal end 522. In one embodiment, centerline 810 may be oriented in a first direction 820 at proximal end 520 that is normal, or perpendicular to, first lateral axis 812. Centerline may further be oriented in a second direction 830 at distal end 522 that is normal to second lateral axis 814.

With this arrangement, the opposite ends of stiffener element 304 may be skewed or offset from each other. As shown in FIG. 8, first direction 820 associated with the orientation of centerline 810 at proximal end 520 may be offset or skewed from second direction 830 associated with the orientation of centerline 810 at distal end 522 by a skew angle SA. Also, FIG. 8 shows a curved proximal end 520 and a curved distal end 522. In one embodiment, first direction 820 may be generally aligned along the vertical direction when stiffener element 304 is associated with an article and second direction 830 may be generally aligned along the longitudinal direction when stiffener element 304 is associated with an article. In some cases, skew angle SA may be approximately 90 degrees. In other cases, skew angle SA may be slightly larger than 90 degrees, including in range from 100 degrees to 115 degrees. In still other cases, skew angle SA may be substantially larger than 90 degrees, including more than 115 degrees, or may be smaller than 90 degrees.

It should be understood that additional stiffener elements, including stiffener element 404, may include substantially similar features as described with regard to stiffener element 304. In addition, in some embodiments, stiffener elements may be configured with shapes that are mirror images so that each stiffener element may be configured for corresponding opposite sides of an article. For example, in the present embodiments, stiffener element 304 and stiffener element 404 may be associated with shapes that are mirror images of each other so that stiffener element 304 may be used on lateral side 16 and stiffener element 404 may be used on medial side 18.

Figure 9:
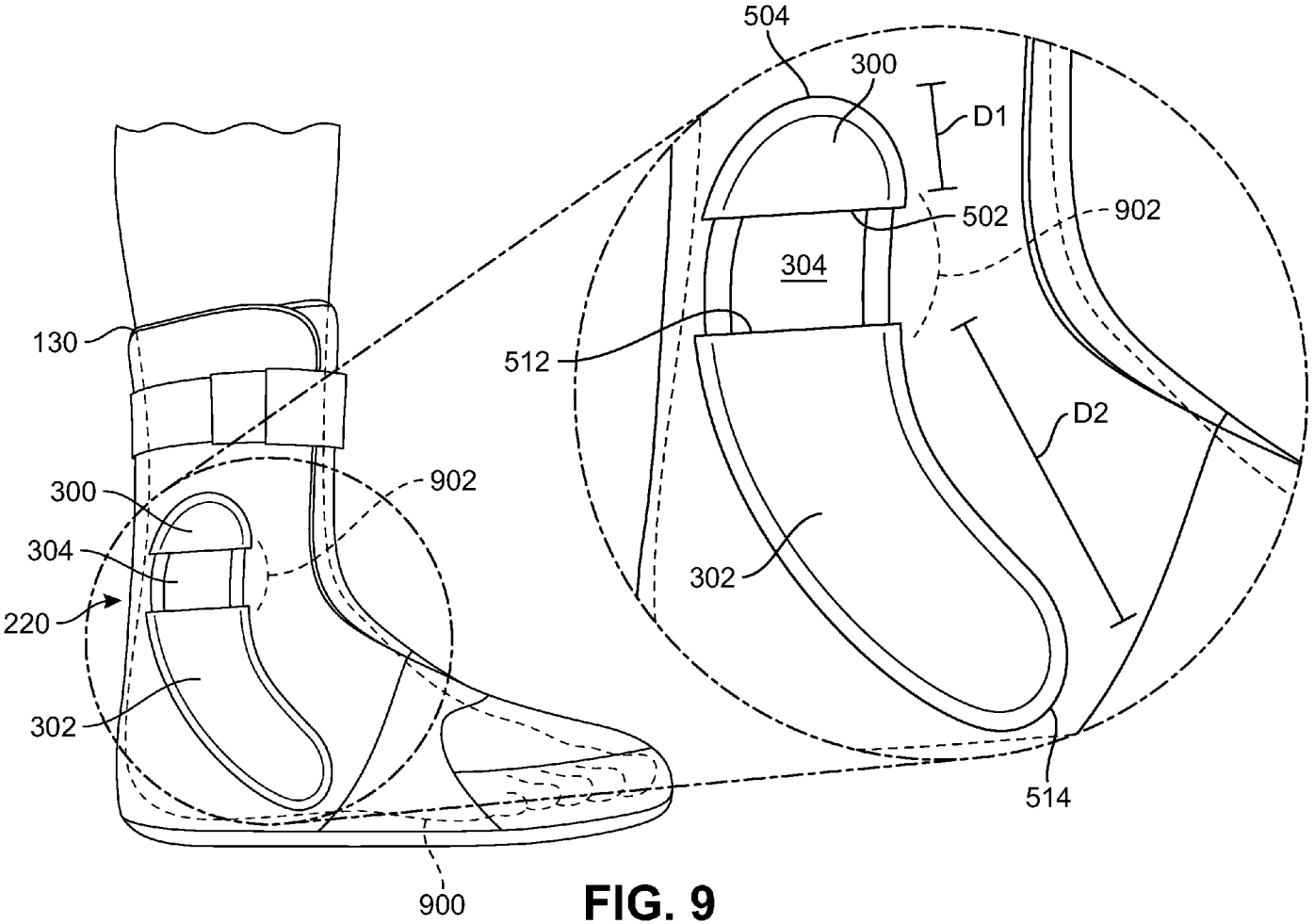
FIG. 9 is a schematic view of a foot of a wearer disposed within an exemplary embodiment of an article of footwear with customizable stiffness.

In some embodiments, stiffening arrangements disposed on lateral side 16 and medial side 18 of inner liner 130 may be configured to generally correspond with the location of an ankle of a foot of a wearer of article 100. Referring now to FIG. 9, a foot 900 of a wearer is shown disposed within inner liner 130. For purposes of ease of illustration, outer shell 110 of article 100 is not shown in FIG. 9, however, it should be understood that inner liner 130 is configured to be disposed within outer shell 110 when article 100 is worn by a wearer. In this embodiment, an ankle 902 of foot 900 of a wearer is generally located within a middle portion of inner liner 130 on lateral side 16. In an exemplary embodiment, lateral stiffening arrangement 220 is configured to generally correspond to the location of ankle 902 when foot 900 is disposed within inner liner 130.

In an exemplary embodiment, upper retaining enclosure 300 may be generally located above ankle 902 and lower retaining enclosure 302 may be generally located below ankle 902. In one embodiment, upper securing end 504 may extend a first distance D1 above ankle 902 and lower securing end 514 may extend a second distance D2 beneath ankle 902. In some cases, second distance D2 may be larger than first distance D1. In one case, second distance D2 may be approximately twice as long as first distance D1. In other cases, first distance D1 and second distance D2 may be approximately equal. In this embodiment, the gap or space between upper receiving end 502 of upper retaining enclosure 300 and lower receiving end 512 of lower retaining enclosure 302 is configured to span across ankle 902. With this arrangement, when stiffener element 304, or any other suitable stiffener element, is inserted within upper retaining enclosure 300 and lower retaining enclosure 302, additional support and stability may be provided to article 100 and/or ankle 902.

Figure 10:
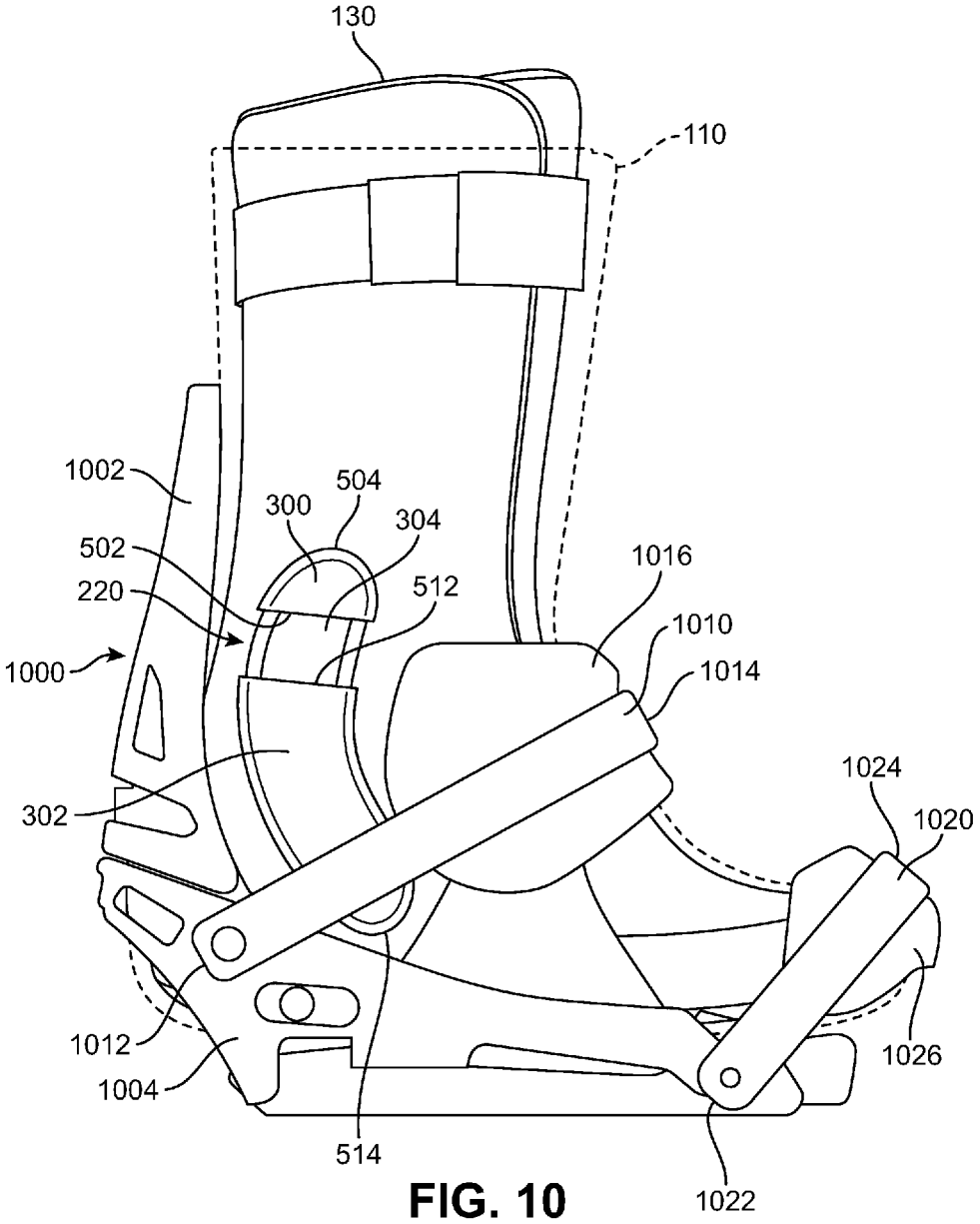
FIG. 10 is a schematic view of an exemplary embodiment of an article of footwear with customizable stiffness disposed within a binding.

In some embodiments, portions of a stiffening arrangement may be configured to interact with additional components to provide stiffness and/or stability to a foot of a wearer when article 100 is worn. Referring now to FIG. 10, an exemplary embodiment of a binding 1000 that may be used with article 100 is illustrated. Binding 1000 may be any suitable conventional binding that is used to secure a boot to a snowboard or a ski. In this embodiment, binding 1000 includes a back portion or highback 1002 which provides support to the back of article 100 and a calf of a wearer. Binding 1000 also includes a base portion or baseplate 1004 which is connected to highback 1002. Baseplate 1004 may further include mechanisms configured to attach binding 1000 to a snowboard or ski.

Binding 1000 further includes mechanisms that are configured to secure article 100 to binding 1000, including one or more straps. In this embodiment, binding 1000 includes an ankle strap 1010 that is attached to baseplate 1004 at a first anchor 1012. When article 100 is disposed within binding 1000, ankle strap 1010 may be secured at first anchor 1012 and extend over the front of outer shell 110 (shown in phantom in FIG. 10) to an opposite side where ankle strap 1010 may be similarly attached to another anchor to tightly fasten or secure article 100 within binding 1000. In this embodiment, an intermediate portion 1014 of ankle strap 1010 is configured to extend over the front of outer shell 110. In addition, in some embodiments, ankle strap 1010 may be used with an ankle pad 1016 that is configured to provide cushioning and distribute the force of ankle strap 1010 over a larger surface area of outer shell 110.

Binding 1000 may further include a toe strap 1020 that is attached to baseplate 1004 at a second anchor 1022. When article 100 is disposed within binding 1000, toe strap 1020 may be secured at second anchor 1022 and extend over the toe area of outer shell 110 to an opposite side where toe strap 1020 may be similarly attached to another anchor to tightly fasten or secure article 100 within binding 1000. In this embodiment, an intermediate portion 1024 of toe strap 1020 is configured to extend over the toe area of outer shell 110. In addition, in some embodiments, toe strap 1020 may be used with a toe pad 1026 that is configured to provide cushioning and distribute the force of toe strap 1020 over a larger surface area of outer shell 110. In different embodiments, binding 1000 may include additional components not depicted in FIG. 10 that are commonly associated with a binding, such as tightening mechanisms disposed on ankle strap 1010 and/or toe strap 1020 to adjust the level of tightening securing article 100 within binding 1000.

In some embodiments, binding 1000 may be configured to interact with stiffening arrangements disposed on article 100, including lateral stiffening arrangement 220 and/or medial stiffening arrangement 222, to provide additional stiffness and support to a foot of a wearer when article 100 is worn. In an exemplary embodiment, the location of lateral stiffening arrangement 220 and/or medial stiffening arrangement 222 may be configured so that a portion of lateral stiffening arrangement 220 and/or medial stiffening arrangement 222 coincides with the location of ankle strap 1010 when article 100 is disposed within binding 1000. In one embodiment, a portion of the lower retaining enclosure disposed on each of lateral side 16 and/or medial side 18 may be configured to coincide with the location of ankle strap 1010 when article 100 is secured within binding 1000. In this embodiment, a portion of lower retaining enclosure 302 adjacent to lower securing end 514 is configured to coincide with the location of ankle strap 1010. A similar configuration may be disposed on medial side 18 with regard to lower retaining enclosure 402. In some embodiments, ankle strap 1010 may hold stiffener elements 304 and 404 in place on inner liner 130 and prevent or reduce lateral movement or deflection of stiffener elements 304 and 404 outward away from inner liner 130. With this arrangement, the interaction of ankle strap 1010 of binding 1000 braces stiffener elements within lateral stiffening arrangement 220 and/or medial stiffening arrangement 222 to assist with providing stiffness and stability to article 100.

Figure 11:
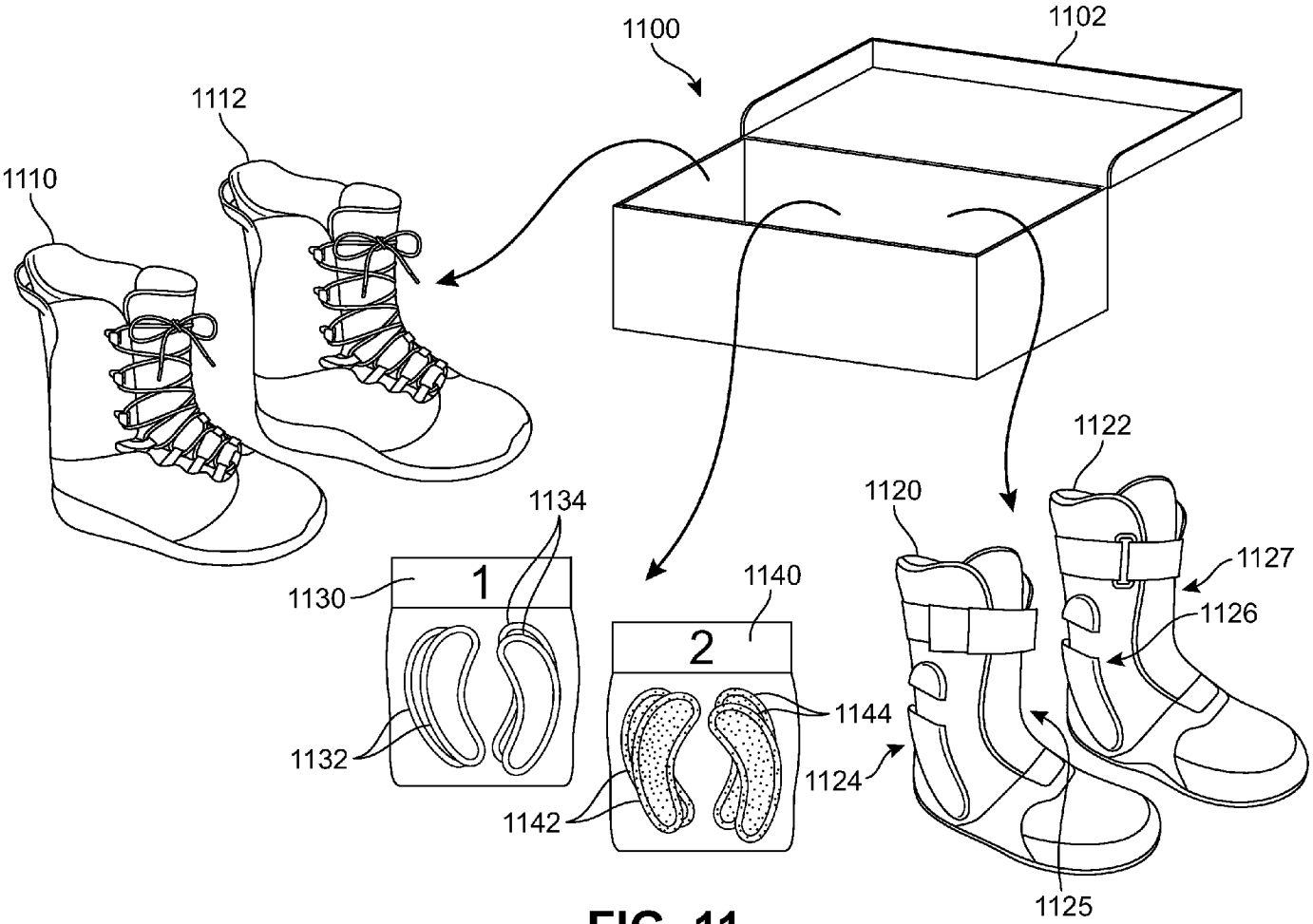
FIG. 11 is a representational view of an exemplary kit of parts including a pair of articles of footwear with customizable stiffness.

In some embodiments, an article of footwear may be provided with customizable stiffness levels or amounts by varying configurations of stiffener elements. FIGS. 11 through 15 illustrate an exemplary embodiment of providing customizable stiffness for an article of footwear to suit a particular wearer. Referring now to FIG. 11, a kit of parts 1100, or simply kit 1100, is illustrated. In some cases, kit 1100 may comprise one or more articles of footwear, accessories for these articles and/or a container for storing the articles. In other cases, kit 1100 could include any other provisions not discussed below including, but not limited to: instructions, various kinds of media (such as CDs, DVDs, etc.), additional storage containers for storing articles and/or article accessories as well as any other provisions.

Kit 1100 may be offered for sale at a retail location, such as a retail store, kiosk, factory outlet, manufacturing store and/or through an online vendor. In some cases, the various parts of kit 1100 are sold together. In other cases, however, some parts of kit 1100 may be sold separately. As an example, the current embodiment describes a kit of parts including a pair of boots, including two outer shells and two inner liners, and two sets of stiffener elements having different levels of rigidity or stiffness. In some cases, a retailer could sell a kit including the boots and two sets of stiffener elements and the retailer could also sell one or more sets of stiffener elements separately from kit 1100.

Kit 1100 may include container 1102. Container 1102 can be any type of container configured to store at least one article of footwear. In some cases, container 1102 may be a box. In an exemplary embodiment, container 1102 may be a shoebox that is configured to store footwear. In particular, container 1102 may have a generally rectangular shape and can include a lower portion and a lid. In other embodiments, container 1012 could be a bag, sack or other type of container. In still other embodiments, the various items in kit 1100 may not be provided in a container.

In some embodiments, kit 1100 includes pair of articles of footwear in the form of snowboard boots that includes first outer shell 1110 and second outer shell 1112 and corresponding inner liners, including first inner liner 1120 and second inner liner 1122. Generally, articles of footwear associated with kit 1100 can be any type of footwear, as described above. In an exemplary embodiment, first outer shell 1110 and second outer shell 1112 may be oriented for a right foot and a left foot, respectively. Similarly, corresponding inner liners, including first inner liner 1120 and second inner liner 1122, may be oriented for a right foot and a left foot, respectively.

In an exemplary embodiment, each of first inner liner 1120 and second inner liner 1122 may be provided with stiffening arrangements on lateral and medial sides of the respective inner liner. In this embodiment, first inner liner 1120 includes a first lateral stiffening arrangement 1124 and a first medial stiffening arrangement 1125. Similarly, second inner liner 1122 includes a second lateral stiffening arrangement 1126 and a second medial stiffening arrangement 1127. Each stiffening arrangement, including first lateral stiffening arrangement 1124, first medial stiffening arrangement 1125, second lateral stiffening arrangement 1126 and/or second medial stiffening arrangement 1127, may include components that are substantially similar to lateral stiffening arrangement 220 and/or medial stiffening arrangement 222, described above.

Kit 1100 may further include a first set of stiffener elements 1130 and a second set of stiffener elements 1140. In an exemplary embodiment, first set of stiffener elements 1130 may include a pair of lateral first stiffener elements 1132 that are configured to be associated with a stiffening arrangement disposed on a lateral side of an inner liner and a pair of medial first stiffener elements 1134 that are configured to be associated with a stiffening arrangement disposed on a medial side of an inner liner. In one embodiment, lateral first stiffener elements 1132 and medial first stiffener elements 1134 may have shapes that are substantially mirror images of each other.

Similarly, in an exemplary embodiment, second set of stiffener elements 1140 may include a pair of lateral second stiffener elements 1142 that are configured to be associated with a stiffening arrangement disposed on a lateral side of an inner liner and a pair of medial second stiffener elements 1144 that are configured to be associated with a stiffening arrangement disposed on a medial side of an inner liner. In one embodiment, lateral second stiffener elements 1142 and medial second stiffener elements 1144 may have shapes that are substantially mirror images of each other.

In some embodiments, different amounts or levels of stiffness may be provided to an article by varying the materials and/or rigidity of stiffener elements. Suitable materials for making stiffener elements may include, but are not limited to: thermoplastic polyurethane (TPU) of various compositions and densities, nylon, elastomers, polymers, plastics, wood, metal, carbon fiber, resins, composite materials, and any other rigid, semi-rigid, or flexible material.

In an exemplary embodiment, first set of stiffener elements 1130 may be made of a first material associated with a first stiffness and second set of stiffener elements 1140 may be made of a second material associated with a second stiffness. In one embodiment, the second stiffness may be greater than the first stiffness. In some cases, the first material and the second material may be different compositions of the same material having different densities and/or rigidities. In other cases, the first material and the second material may be different materials having different stiffness and/or rigidities. In still other cases, the first material and the second material may be substantially similar, however, the thickness of the stiffener elements in each of first set of stiffener elements 1130 and second set of stiffener elements 1140 may be varied to impart a greater stiffness and/or rigidity. For example, in cases where the first material and the second material are substantially similar, second set of stiffener elements 1140 may be substantially thicker than first set of stiffener elements 1130 so that second set of stiffener elements 1140 has a greater stiffness and/or rigidity than first set of stiffener elements 1130.

Figure 12:
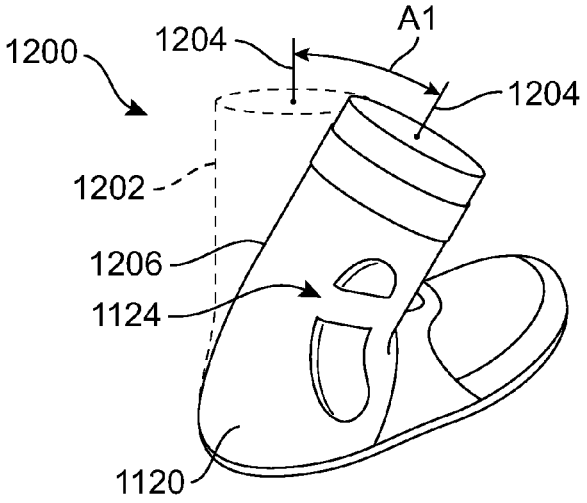
FIG. 12 is a representational view of an exemplary flex profile associated with an article of footwear with customizable stiffness.
Figure 13:
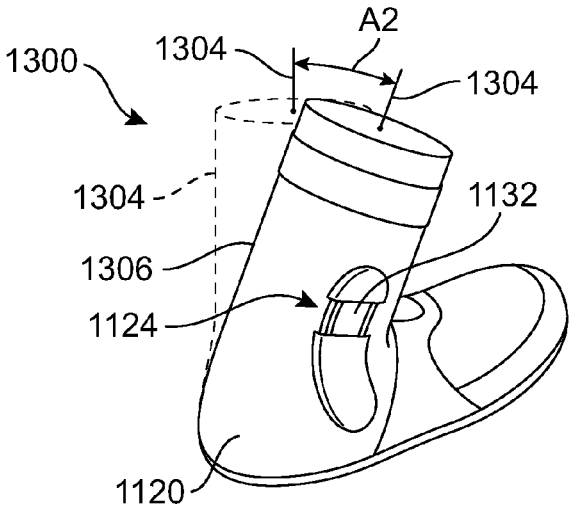
FIG. 13 is a representational view of an exemplary flex profile associated with an article of footwear with customizable stiffness.
Figure 14:
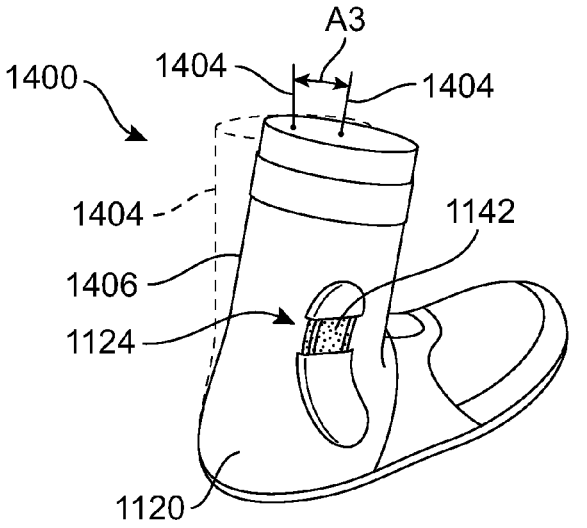
FIG. 14 is a representational view of an exemplary flex profile associated with an article of footwear with customizable stiffness.

In some embodiments, kit 1100 may be provided to allow a wearer of the pair of articles of footwear to customize the stiffness of an individual article of footwear using the components of kit 1100. In an exemplary embodiment, a wearer may select or configure an article of footwear to have different flex profiles that permit varying amounts or degrees of stiffness and/or flexibility. Referring now to FIGS. 12 through 14, exemplary embodiments of different flex profiles that may be configured for an article of footwear using different stiffener elements within stiffening arrangements are illustrated. In FIGS. 12 through 14, exemplary embodiments of flex profiles are illustrated for use with first inner liner 1120, however, it should be understood that the same principles apply to second inner liner 1122. In addition, for the purposes of illustration, first outer shell 1110 and second outer shell 1112 are not shown, but are part of the pair of articles of footwear as worn by a wearer and may be worn within a binding and/or outside of a binding.

Referring now to FIG. 12, a first flex profile 1200 is illustrated. In an exemplary embodiment, first flex profile 1200 may be associated with first lateral stiffening arrangement 1124 that is empty and does not include a stiffener element. As shown in FIG. 12, first inner liner 1120 having first flex profile 1200 may have an original configuration 1202 with an approximately vertical central axis 1204. When first inner liner 1120 having first flex profile 1200 is bent or placed into a flexed configuration 1206, central axis 1204 may travel through a first angle A1. In some cases, an article of footwear having first flex profile 1200 may not travel through the entirety of first angle A1, however, first angle A1 may represent the maximum amount of travel that an article with first flex profile 1200 may be capable of in a given circumstance.

Referring now to FIG. 13, a second flex profile 1300 is illustrated. In an exemplary embodiment, second flex profile 1300 may be associated with first lateral stiffening arrangement 1124 that includes at least one lateral first stiffener element 1132 that is associated with a first stiffness. As shown in FIG. 13, first inner liner 1120 having second flex profile 1300 may have an original configuration 1302 with an approximately vertical central axis 1304. When first inner liner 1120 having second flex profile 1300 is bent or placed into a flexed configuration 1306, central axis 1304 may travel through a second angle A2. In some cases, an article of footwear having second flex profile 1300 may not travel through the entirety of second angle A2, however, second angle A2 may represent the maximum amount of travel that an article with second flex profile 1300 may be capable of in a given circumstance. In an exemplary embodiment, second flex profile 1300 is associated with a greater amount or degree of stiffness than first flex profile 1200 such that second angle A2 is smaller than first angle A1.

Referring now to FIG. 14, a third flex profile 1400 is illustrated. In an exemplary embodiment, third flex profile 1400 may be associated with first lateral stiffening arrangement 1124 that includes at least one lateral second stiffener element 1142 that is associated with a second stiffness that is greater than the first stiffness associated with lateral first stiffener element 1132. As shown in FIG. 14, first inner liner 1120 having third flex profile 1400 may have an original configuration 1402 with an approximately vertical central axis 1404. When first inner liner 1120 having third flex profile 1400 is bent or placed into a flexed configuration 1406, central axis 1404 may travel through a third angle A3. In some cases, an article of footwear having third flex profile 1400 may not travel through the entirety of third angle A3, however, third angle A3 may represent the maximum amount of travel that an article with third flex profile 1400 may be capable of in a given circumstance. In an exemplary embodiment, third flex profile 1400 is associated with a greater amount or degree of stiffness than both of second flex profile 1300 and first flex profile 1200 such that third angle A3 is smaller than both of second angle A2 and first angle A1. In addition, in some embodiments, third angle A3 may be negligible such that central axis 1404 is essentially restrained from any travel.

While the exemplary embodiments of FIGS. 12 through 14 illustrate various flex profiles, it should be understood that other combinations of flex profiles having larger or smaller flex angles may be provided by the use of different stiffener elements having different material properties or varying amounts of stiffness and/or rigidity.

Figure 15:
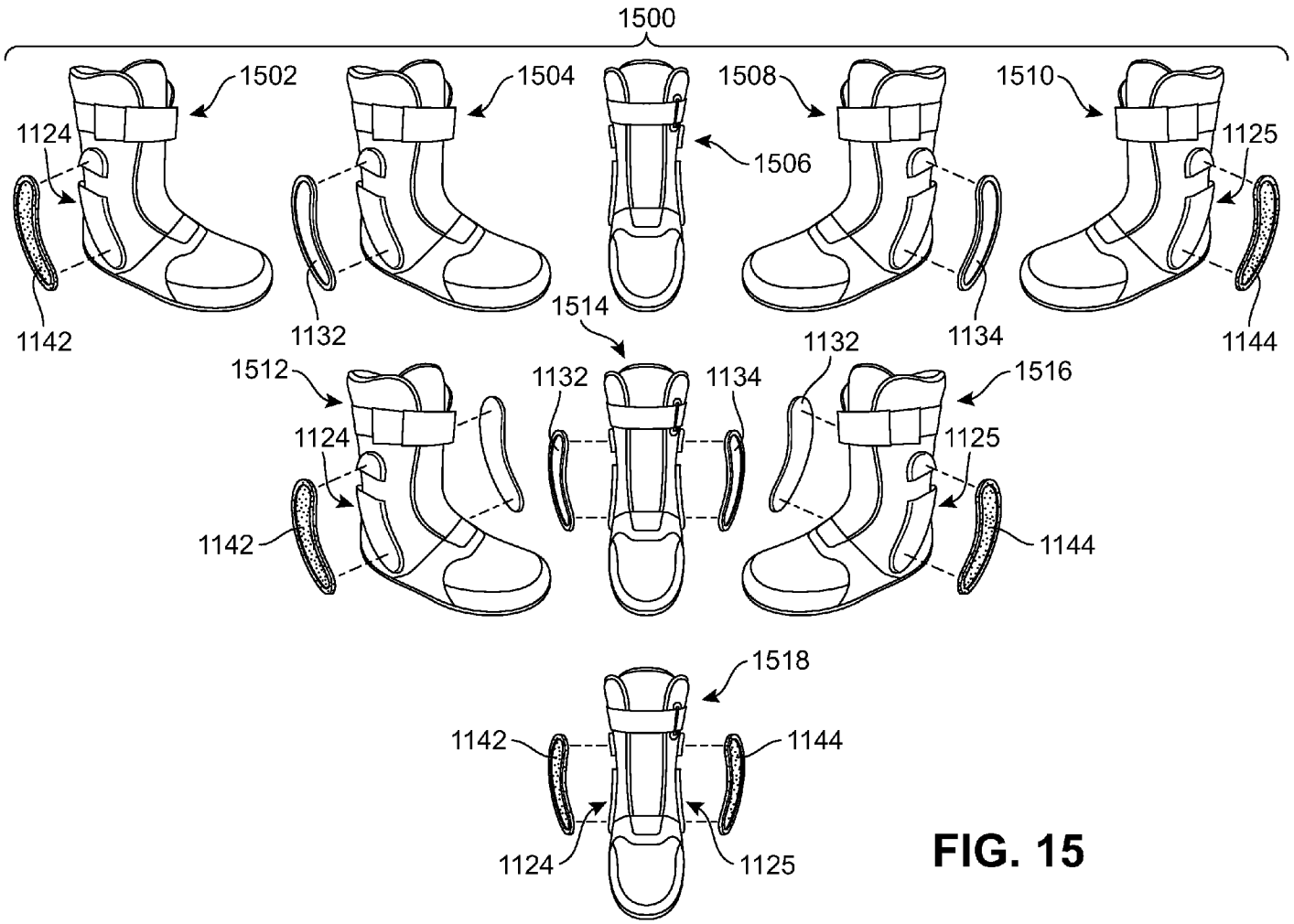
FIG. 15 is a schematic view of various exemplary stiffness configurations associated with an article of footwear with customizable stiffness.

In some embodiments, kit 1100 may provide a wearer with an assortment of different configurations of stiffener elements and stiffening arrangements to provide a customizable stiffness to an article of footwear. Referring now to FIG. 15, a set of customizable stiffness configurations 1500 is illustrated with regard to the various components of kit 1100, including stiffener elements associated with each of first set of stiffener elements 1130 and second set of stiffener elements 1140. In other embodiments where a larger or smaller number of different types of stiffener elements are provided, set of customizable stiffness configurations 1500 may be correspondingly larger or smaller.

As shown in FIG. 15, set of customizable stiffness configurations 1500 illustrates the options for customizable stiffness for a single article of footwear that includes first inner liner 1120. It should be understood that substantially similar options may also be provided for a matching article of footwear that includes second inner liner 1122. In addition, in various embodiments, the stiffness configurations for each of a right article of footwear and a left article of footwear may be different, for example, to provide a greater amount or degree of stiffness to a lead foot when used in connection with a snowboard.

In some embodiments, set of customizable stiffness configurations 1500 may include various configurations for customizing the stiffness of first inner liner 1120 using combinations of stiffener elements having different levels of stiffness or rigidities, including lateral first stiffener element 1132 and medial first stiffener element 1134 associated with a first stiffness and lateral second stiffener element 1142 and medial second stiffener element 1144 associated with a second stiffness that is greater than the first stiffness. The stiffener elements may be used with either or both of first lateral stiffening arrangement 1124 and first medial stiffening arrangement 1125 to vary the stiffness between opposite sides of first inner liner 1120. In addition, first inner liner 1120 may also be used without any stiffener elements on either or both sides to provide a lesser amount or degree of stiffness and a greater amount of flexibility to an article.

In an exemplary embodiment, set of customizable stiffness configurations 1500 may include a first configuration 1502 that is associated with lateral second stiffener element 1142 disposed only within first lateral stiffening arrangement 1124 to provide a high degree or amount of stiffness to the lateral side of an article and a low degree or amount of stiffness to the medial side, which does not include any stiffener element. A second configuration 1504 may be associated with lateral first stiffener element 1132 disposed within first lateral stiffening arrangement 1124 to provide a medium degree or amount of stiffness to the lateral side of an article and a low degree of stiffness to the medial side, which does not include any stiffener element. A third configuration 1506 may be associated with no stiffener elements on both of the lateral and medial sides so as to provide a low degree of stiffness on both sides of an article. A fourth configuration 1508 may be associated with medial first stiffener element 1134 disposed within first medial stiffening arrangement 1125 to provide a medium degree of stiffness to the medial side of an article and a low degree of stiffness to the lateral side, which does not include any stiffener element. A fifth configuration 1510 may be associated with medial second stiffener element 1144 disposed within first medial stiffening arrangement 1125 to provide a high degree of stiffness to the medial side of an article and a low degree of stiffness to the lateral side, which does not include any stiffener element.

Set of customizable stiffness configurations 1500 may further include a sixth configuration 1512 that is associated with lateral second stiffener element 1142 disposed within first lateral stiffening arrangement 1124 and medial first stiffener element 1134 disposed within first medial stiffening arrangement 1125 to provide a high degree or amount of stiffness to the lateral side of an article and a medium degree of stiffness to the medial side of an article. A seventh configuration 1514 may include lateral first stiffener element 1132 disposed within first lateral stiffening arrangement 1124 and medial first stiffener element 1134 disposed within first medial stiffening arrangement 1125 to provide a medium degree or amount of stiffness to both sides of an article. An eighth configuration 1516 may include medial second stiffener element 1144 disposed within first medial stiffening arrangement 1125 and lateral first stiffener element 1132 disposed within first lateral stiffening arrangement 1124 to provide a high degree of stiffness to the medial side of an article and a medium degree or amount of stiffness to the lateral side of an article. Finally, a ninth configuration 1518 may include lateral second stiffener element 1142 disposed within first lateral stiffening arrangement 1124 and medial second stiffener element 1144 disposed within first medial stiffening arrangement 1125 to provide a high degree of stiffness to both sides of an article.

The present embodiments described herein may be used by a wearer to provide a customizable stiffness to any one or more of a right boot, a left boot, as well as a lateral side and a medial side of each of a right boot and a left boot. With this arrangement, a wearer may customize the stiffness of articles of footwear to provide for various snowboard riding conditions and/or styles of snowboard riding. In addition, a wearer may carry or have access to interchangeable stiffener elements to vary the stiffness of articles of footwear during a single outing or event.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

an outer shell, the outer shell including an upper and a sole structure; an inner liner, the inner liner being configured to be removably inserted within an interior of the outer shell;

wherein the inner liner comprises an upper liner portion and a lower liner portion;

a first retaining enclosure comprising a first securing end and a first receiving end disposed on the upper liner portion of the inner liner; a second retaining enclosure comprising a second securing end and a second receiving end, wherein the second retaining enclosure is disposed across at least a portion of the upper liner portion and a portion of the lower liner portion; the second retaining enclosure extending in a longitudinal direction being disposed beneath the first retaining enclosure;

a stiffener element comprising a first end shaped approximately the same as the first securing end, an opposite end shaped approximately the same as the second securing end, wherein the stiffener element has an oval shape with concavity on one side, and wherein the first end and the opposite end are curved; and wherein the first retaining enclosure and the second retaining enclosure are configured to receive the stiffener element that extends from the first retaining enclosure to the second retaining enclosure.

2. The article of footwear according to claim 1, wherein the first retaining enclosure and the second retaining enclosure are spaced apart by a gap.

3. The article of footwear according to claim 2, wherein the stiffener element is configured to be inserted within the first retaining enclosure and the second retaining enclosure through the gap; and wherein the stiffener element has a width substantially similar to the same as a width of the gap.

4. The article of footwear according to claim 1, wherein the first securing end of the first retaining enclosure is disposed adjacent to a top end of the inner liner.

5. The article of footwear according to claim 1, wherein the second securing end of the second retaining enclosure is disposed adjacent to a bottom of the inner liner.

6. The article of footwear according to claim 1, wherein the second retaining enclosure is disposed along the inner liner through at least a portion of a heel region and a portion of a midfoot region of the inner liner.

7. The article of footwear according to claim 1, wherein the first retaining enclosure is configured to extend above an ankle of a foot disposed within the article of footwear; and wherein the second retaining enclosure is configured to extend beneath the ankle of the foot disposed within the article of footwear.

8. The article of footwear according to claim 7, wherein the first retaining enclosure extends a first distance above the ankle when the foot is disposed within the article of footwear and the second retaining enclosure extends a second distance beneath the ankle when the foot is disposed within the article of footwear; and wherein the first distance is smaller than the second distance.

9. The article of footwear according to claim 1, wherein the article of footwear is associated with a first flex profile having a first flex angle when the first retaining enclosure and the second retaining enclosure do not include the stiffener element.

10. The article of footwear according to claim 9, wherein the article of footwear is associated with a second flex profile having a second flex angle when the first retaining enclosure and the second retaining enclosure include the stiffener element; and wherein the second flex angle is smaller than the first flex angle.

11. An article of footwear comprising:

an outer shell, the outer shell including an upper and a sole structure; an inner liner, the inner liner being configured to be removably inserted within an interior of the outer shell;

wherein the inner liner comprises an upper liner portion and a lower liner portion;

a stiffening arrangement disposed on at least one of a lateral side and a medial side of the inner liner, the stiffening arrangement being disposed through at least a portion of the upper liner portion and a portion of the lower liner portion;

wherein the stiffening arrangement comprises a stiffener element disposed within a first retaining enclosure disposed on the upper liner portion and a portion of the lower liner portion, the stiffener element having a curved first end and a curved opposite end;

wherein the second retaining enclosure extending in a longitudinal direction is disposed beneath the first retaining enclosure; and wherein the stiffener element has a first width approximately to the same as a width of the first retaining enclosure and a second width approximately to the same as a width of the second retaining enclosure; and wherein the stiffening arrangement provides varying degree of flexibility for the article of footwear.

12. The article of footwear according to claim 11, wherein the first retaining enclosure comprises a first securing end and a first receiving end, the first retaining enclosure including a first opening disposed at the first receiving end; and wherein the second retaining enclosure comprises a second securing end and a second receiving end, the second retaining enclosure including a second opening disposed at the second receiving end.

13. The article of footwear according to claim 12, wherein the stiffener element is disposed through the first opening and the second opening.

14. The article of footwear according to claim 13, wherein the first receiving end of the first retaining enclosure and the second receiving end of the second retaining enclosure are spaced apart by a gap.

15. The article of footwear according to claim 14, wherein the stiffener element is disposed across the gap and wherein the width of the stiffener element is substantially the same as a width of the gap.

16. The article of footwear according to claim 12, wherein the stiffener element comprises a proximal end and a distal end opposite the proximal end; and wherein the proximal end of the stiffener element is associated with the first securing end of the first retaining enclosure and the distal end of the stiffener element is associated with the second securing end of the second retaining enclosure.

17. The article of footwear according to claim 11, wherein the stiffener element is approximately comma-shaped.

18. The article of footwear according to claim 11, wherein the stiffener element includes a first side that has a convex shape and a second side that has a concave shape.

19. The article of footwear according to claim 11, wherein the article of footwear is configured to be held by a binding.

20. The article of footwear according to claim 19, wherein the binding includes at least one strap; and wherein the at least one strap is configured to coincide with at least a portion of the second retaining enclosure.

21. An article of footwear comprising:

an outer shell, the outer shell including an upper and a sole structure; an inner liner, the inner liner being configured to be removably inserted within an interior of the outer shell;

at least one stiffener element associated with at least one of a lateral side and a medial side of the inner liner, wherein the at least one stiffener element has an oval shape including a first side that has a convex shape and a second side that has a concave shape;

wherein the at least one stiffener element has a distal end and a proximal end, the distal end and the proximal end are curved;

the at least one stiffener element having a centerline disposed along a middle of the stiffener element along a longitudinal direction, the centerline extending from a first end to a second end opposite the first end, wherein the at least one stiffener element provides a varying degree of flexibility for the article of footwear; and wherein the centerline has a first orientation at the first end and a second orientation at the second end, the first orientation being different than the second orientation.

22. The article of footwear according to claim 21, wherein the first orientation and the second orientation are offset by a skew angle.

23. The article of footwear according to claim 22, wherein the skew angle is greater than 90 degrees.

24. The article of footwear according to claim 21, wherein the first orientation is approximately along a vertical direction of the article of footwear and wherein the second orientation is approximately along a longitudinal direction of the article of footwear.

25. The article of footwear according to claim 21, wherein the at least one stiffener element comprises at least one of a rigid material or a semi-rigid material.

26. The article of footwear according to claim 21, wherein the at least one stiffener element further comprises a lip extending around an outer peripheral edge of the stiffener element.

27. The article of footwear according to claim 26, wherein the lip is associated with a first width from the outer peripheral edge to an inner peripheral edge.

28. The article of footwear according to claim 27, wherein the lip extends above a surface of the at least one stiffener element by a first thickness.

29. The article of footwear according to claim 21, wherein the inner liner further comprises an upper liner portion and a lower liner portion;

the inner liner including a first retaining enclosure disposed on the upper liner portion of the inner liner and a second retaining enclosure disposed across at least a portion of the upper liner portion and a portion of the lower liner portion; and wherein the at least one stiffener element is disposed within the first retaining enclosure and the second retaining enclosure along the at least one of the lateral side and the medial side of the inner liner.

30. The article of footwear according to claim 21, wherein the at least one stiffener element further comprises a first stiffener element disposed on the lateral side of the inner liner and a second stiffener element disposed on the medial side of the inner liner.

31. A kit of parts, the kit comprising:

at least one article of footwear, the article of footwear including an outer shell and an inner liner;

at least one set of stiffener elements that are configured to be inserted within a stiffening arrangement disposed on the inner liner, wherein the at least one set of stiffener elements has an oval shape including a first side that has a convex shape and a second side that has a concave shape;

wherein the at least one set of stiffener elements has a first end and an opposite end, the first end and the opposite end are curved;

wherein the inner liner comprises an upper an upper liner portion and a lower liner portion;

wherein the inner liner includes the stiffening arrangement disposed on each of a lateral side and a medial side of the inner liner, each stiffening arrangement being disposed through at least a portion of the upper liner portion and a portion of the lower liner portion;

wherein each stiffening arrangement comprises a first retaining enclosure disposed on the upper liner portion of the inner liner and a second retaining enclosure disposed across at least a portion of the upper liner portion and a portion of the lower liner portion;

wherein the article of footwear has a variable flex profile after insertion of the at least one set of stiffener elements into the first retaining enclosure and the second retaining enclosure; and wherein the second retaining enclosure extending in a longitudinal direction is disposed beneath the first retaining enclosure.

32. The kit according to claim 31, wherein the at least one article of footwear comprises a pair of articles of footwear.

33. The kit according to claim 31, wherein the at least one set of stiffener elements further comprises a first set of stiffener elements and a second set of stiffener elements; and wherein the first set of stiffener elements are associated with a first stiffness and the second set of stiffener elements are associated with a second stiffness that is greater than the first stiffness.

34. The kit according to claim 33, wherein the at least one article of footwear is associated with a first flex profile having a first flex angle when the first retaining enclosure and the second retaining enclosure do not include any stiffener element.

35. The kit according to claim 34, wherein the article of footwear is associated with a second flex profile having a second flex angle when the first retaining enclosure and the second retaining enclosure include at least one stiffener element associated with the first set of stiffener elements; and wherein the second flex angle is smaller than the first flex angle.

36. The kit according to claim 35, wherein the article of footwear is associated with a third flex profile having a third flex angle when the first retaining enclosure and the second retaining enclosure include at least one stiffener element associated with the second set of stiffener elements; and wherein the third flex angle is smaller than both of the second flex angle and the first flex angle.

37. The kit according to claim 36, wherein the third flex angle is negligible.

38. The kit according to claim 31, wherein the article of footwear is configured to be held by a binding.

39. The kit according to claim 38, wherein the binding includes at least one strap; and wherein the at least one strap is configured to coincide with at least a portion of the second retaining enclosure.

40. The kit according to claim 31, wherein the stiffening arrangement is configured to be used with a plurality of stiffener elements that are interchangeable to provide a customizable stiffness configuration.

* * * * *